US005617196A

United States Patent [19]

Ueda et al.

[11] Patent Number: 5,617,196

[45] Date of Patent: Apr. 1, 1997

[54] ORIGINAL FEEDING METHOD WITH ORIGINALS MOUNTED SIDE BY SIDE

[75] Inventors: Noriyoshi Ueda; Masaaki Sato, both of Yokohama; Katsuaki Hirai, Kawasaki, all of Japan

[73] Assignee: Canon Kabushiki Kaisha, Tokyo, Japan

[21] Appl. No.: 578,393

[22] Filed: Dec. 26, 1995

Related U.S. Application Data

[63] Continuation of Ser. No. 223,138, Apr. 5, 1994, abandoned, which is a continuation of Ser. No. 750,398, Aug. 27, 1991, abandoned.

[30] Foreign Application Priority Data

| | | | |
|---|---|---|---|
| Aug. 29, 1990 | [JP] | Japan | 2-228583 |
| Jul. 12, 1991 | [JP] | Japan | 3-172301 |
| Jul. 16, 1991 | [JP] | Japan | 3-175167 |

[51] Int. Cl.[6] ..... G03G 15/00

[52] U.S. Cl. ..... 399/379; 399/405

[58] Field of Search ..... 355/308, 309, 355/323, 313–4, 204, 75, 24, 25, 203, 320–322; 271/8.1, 3.01, 3.08, 3.04, 145, 184

[56] References Cited

U.S. PATENT DOCUMENTS

| | | | |
|---|---|---|---|
| 3,997,263 | 12/1976 | Stemmle | 355/24 |
| 4,184,671 | 1/1980 | Sasamori | 355/309 X |
| 4,660,957 | 4/1987 | Ueda et al. . | |
| 4,727,402 | 2/1988 | Smith | 355/321 X |
| 4,731,637 | 3/1988 | Acquaviva et al. | 355/317 |
| 4,912,518 | 3/1990 | Matsuo et al. | 355/317 |
| 4,934,683 | 6/1990 | Ueda et al. | 271/3 |
| 4,935,775 | 6/1990 | Ueda et al. | 355/202 |
| 4,958,198 | 9/1990 | Hamakawa | 355/309 |
| 5,079,599 | 1/1992 | Kato et al. | 355/321 X |
| 5,204,728 | 4/1993 | Braswell | 355/323 |

FOREIGN PATENT DOCUMENTS

| | | | |
|---|---|---|---|
| 60-2942 | 1/1985 | Japan | G03B 27/62 |
| 60-93462 | 5/1985 | Japan | G03G 15/00 |
| 60-84945 | 5/1985 | Japan | H02K 15/02 |
| 62-55667 | 3/1987 | Japan | G03G 15/00 |
| 62-125626 | 6/1987 | Japan | H01L 21/302 |

*Primary Examiner*—Thu A. Dang

*Attorney, Agent, or Firm*—Fitzpatrick, Cella, Harper & Scinto

[57] ABSTRACT

An original feeding method for resting a plurality of originals on a platen side-by-side by using a recycle original feeding apparatus having a tray (thereby replacing a page sequence of the plural originals) includes the step of replacing a page sequence of the plural originals by resting the originals from the tray on the platen side-by-side in a feeding direction. The plural originals are then returned onto the tray from the platen in a stacking page sequence, and the plural originals returned to the tray and replaced in the stacking page sequence are rested on the platen side-by-side in the feeding direction.

34 Claims, 26 Drawing Sheets

ORIGINAL FEEDING METHOD WITH ORIGINALS MOUNTED SIDE BY SIDE

This application is a continuation of Application Ser. No. 08/223,138 filed Apr. 5, 1994, which is a continuation of Application Ser. No. 07/750,398 filed Aug. 27, 1991, both now abandoned.

BACKGROUND OF THE INVENTION

1. Field of the Invention

The present invention relates to an original feeding method, and more particularly, it relates to an original feeding method used with an image forming system such as a copying machine, laser beam printer and the like.

2. Related Background Art

In the past, as a method for copying two images recorded on two originals on the same surface of a single sheet by using an original treating apparatus, a method for feeding two originals onto an original support glass in such a manner that the two originals are rested on the support glass side by side (referred to as "side-by-side reading mode" hereinafter) has been proposed, as disclosed in the Japanese Patent Laid-Open Nos. 60-2942, 60-84945, 60-93462 and the like.

By the way, as for the original treating sequence, when the originals are treated from a first page to a last page, in order to attain the page sequence, the originals and transfer sheets after treatment must be ejected with their image surfaces facing downwardly (face down), with the result that the visual check is worsened, leading to the delay of the discovery of disorder of pages and poor image. On the other hand, when the originals are treated from the last page to the first page, although the above problem can be solved, if the number of the originals is odd in the above-mentioned side-by-side reading mode, the first page of the transfer sheet after treatment (particularly, the left half of the first page) will be blank. In order to solve this problem, as disclosed in the Japanese Patent Laid-Open No. 62-55667, an odd selection button is provided in an operation portion so that, when the "odd" is selected by the odd selection button, only the image on the last page is transferred onto the single transfer sheet without using the side-by-side reading mode (of course, other pages are treated in the side-by-side reading mode), thus avoiding the blank portion on the first page of the transfer sheet.

However, in the above conventional technique (Japanese Patent Laid-Open No. 62-55667), there arise problems that an operator must judge whether the originals are odd or not and that, as can be seen from FIG. 26, since the originals are set with their image surfaces facing downwardly (face down), the desired copies cannot be obtained unless the operator carefully set the originals.

More specifically, although the originals should generally be set with their image surfaces facing downwardly so that the last page is an uppermost original, if the operator sets the originals upside down, when the copying operation is effected with a scan direction and a copy sheet convey direction as shown in FIG. 28, the wrong copy as shown in FIG. 27B will be obtained, contrary to the correct copy as shown in FIG. 27A. Unfortunately, the risk that the originals are set upside down will be increased, when they are set with their image surfaces facing downwardly, in comparison with the setting of the originals with their image surfaces facing upwardly.

Alternatively, with the arrangements as shown in FIGS. 26 and 28 wherein a side from which the original is introduced onto a platen (right side of these Figures) is opposite to a scan reference side (left side), since a distance between an original tray and the scan reference position is longer in a normal copy mode other than the side-by-side reading mode, it is hard to obtain the fast copy quickly. Nowadays, it is very important to reduce the copying time for the fast copy, in view of the high speed copying machine.

On the other hand, with the arrangement as shown in FIG. 29, since the original is introduced into the copying machine from the scan reference side (left side), the fast copy can be obtained quickly. However, since the originals are set on the platen as shown in FIG. 30 in the side-by-side reading mode, the left and right halves on the copy sheet are reversed, with the result that, when the copy sheet is folded in two and a plurality of copy sheets are stapled, the page sequence will be disordered. Further, as shown in FIG. 31, when the last page original is set on the platen at the scan reference side, the obtained copy sheet will be as shown, thereby generating the blank page between the last page and the previous page. Consequently, after the copy sheets are folded in two and are stapled, there arise blank pages in the stapled article.

SUMMARY OF THE INVENTION

The present invention aims to eliminate the above-mentioned conventional drawbacks, and has an object to provide an original feeding method which can reduce an operator's labor and miss-operation and further does not decrease the copying speed (for fast copying) in a normal copy mode and therefore maintains the balance in the system.

According to the present invention, the original feeding method utilizes a recycle original feeding system and is characterized in that, in the side-by-side reading mode (wherein a plurality of originals are rested on a platen and read or scanned sequentially), the method performs the steps of counting the number of originals, changing the originals, and reading the originals.

Further, the original feeding method wherein a plurality of originals are automatically rested on the platen side by side includes an odd discriminating mode for discriminating whether the originals are odd or not, and a replacing mode for replacing the order of a plurality of originals before such originals are rested on the platen.

In the present invention, it is possible to maintain the operability and utility of a conventional original feeding system and to perform the side-by-side reading mode without making the system complex and large-sized, thus reducing the cost of the system.

According to the present invention, it is possible to automatically perform the copying operation in the side-by-side reading mode only by the operator's mode selection and to reduce the possibility of the miss-selection of the original set direction. Further, the present invention provides an original feeding method (and apparatus) which does not reduce the copying time for the fast copy in the normal mode due to the importance of the side-by-side reading mode and maintains the total balance of the system.

Further, according to the present invention, in the mode wherein two originals are copied on a single sheet (i.e., side-by-side reading mode), it is possible to easily form the images corresponding to the plural originals on the same surface of a single sheet and to permit high speed treatment, because of the provisions of the odd discriminating means and the replacing means for replacing the order of the plurality of originals to be copied on the same surface of the single sheet before such originals are rested on the platen.

Further, when the number of the originals is odd, by changing an original stop position on the platen regarding the last page original on the basis of information from an input means for inputting an image forming pattern for the last page original, it is possible to obtain a registered copy set.

In addition, according to the present invention, in the conventional original feeding system, it is possible to perform the side-by-side copy mode by temporarily retarding an m page original from the platen meanwhile feeding an (m−1) page original on the platen and by concurrently feeding these two originals. Also, it is also possible to perform the side-by-side copy mode without the complexity of the system and without reduction of the operability of the conventional system.

DESCRIPTION OF THE PREFERRED EMBODIMENTS

Figure 1:
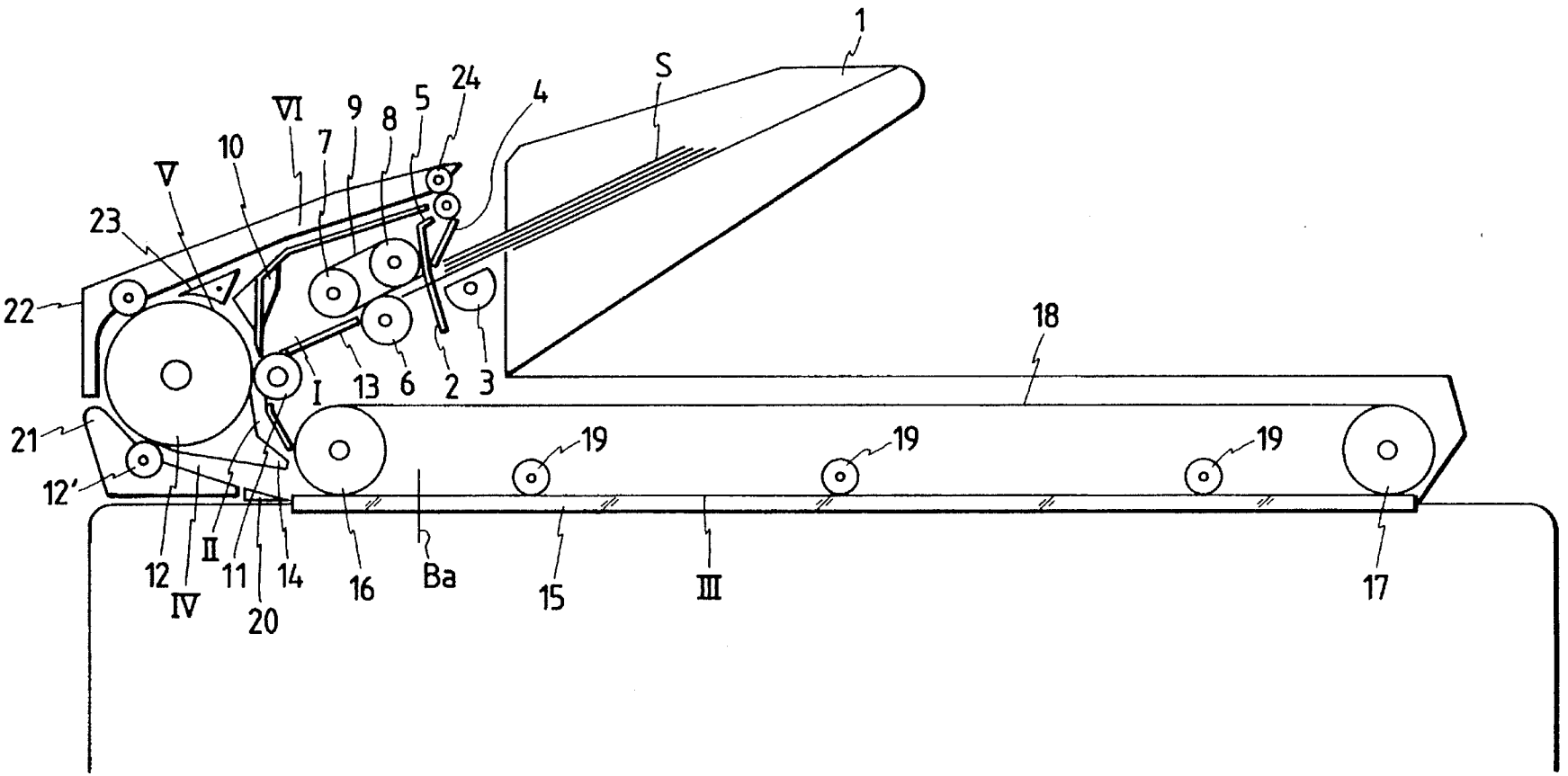
FIG. 1 is an elevational sectional view of a recycle original feeding apparatus for carrying out the present invention.

FIG. 1 shows a recycle original feeding apparatus for carrying out the present invention according to a preferred embodiment of the present invention.

Briefly explaining the construction of the apparatus, a stack of originals S can be housed in an original tray 1. The reference numeral 2 denotes an original stopper against which leading ends of the originals are abutted. A semi-circular roller 3 is associated with the leading end of the original and serves to supply a lowermost original from the tray. When the original is hard to be introduced into a separating portion, a weight 4 can fall on the original stack S to urge the original stack against the semi-circular roller 3 and to aid the supplying of the original. A separation regulating plate 5 serves to prevent the original stack S from entering into the separating portion all at one time. A sheet supply roller 6 cooperates with a pair of separating rollers 7, 8 and a separating belt 9 to separate the lowermost original from the original stack. A leading end portion of an upper guide is designed so that the original can easily be entered into a regist nip between a regist roller 11 and an inversion roller 12. An inner guide 13 and an intermediate guide 14 form an original feeding path II and serve to direct the original onto a platen 15. The original is fed to the platen 15 by means of a convey belt 18 extending between a drive roller 16 and a turn roller 17, and a plurality of small rollers 19 for pressurizing the belt from inner side thereof. When a trailing end of the original reaches a reference point Ba, the original is stopped (After the trailing end of the original is detected by a sensor disposed in the original feeding path II, a predetermined amount is counted). After the copying operation, the convey belt 18 is rotated reversely, so that the original is fed to a path formed between a lower guide 21 and the intermediate guide 14, via a jump member 20. Thereafter, the original is further fed through a space between an openable guide 22 and the inversion roller 12 and then passes through above a flapper 23 and the upper guide 10 to reach a pair of ejector rollers 24 by which the original is ejected onto the ejection tray 1.

Incidentally, in the both-surface copying operation, the flapper 23 is deflected so that the original can pass through an inversion path V formed below the flapper and is fed again onto the platen through the feeding path II by means of the regist roller 11 and the inversion roller 12.

Next, an operation in a side-by-side reading mode will be explained.

Figure 2:
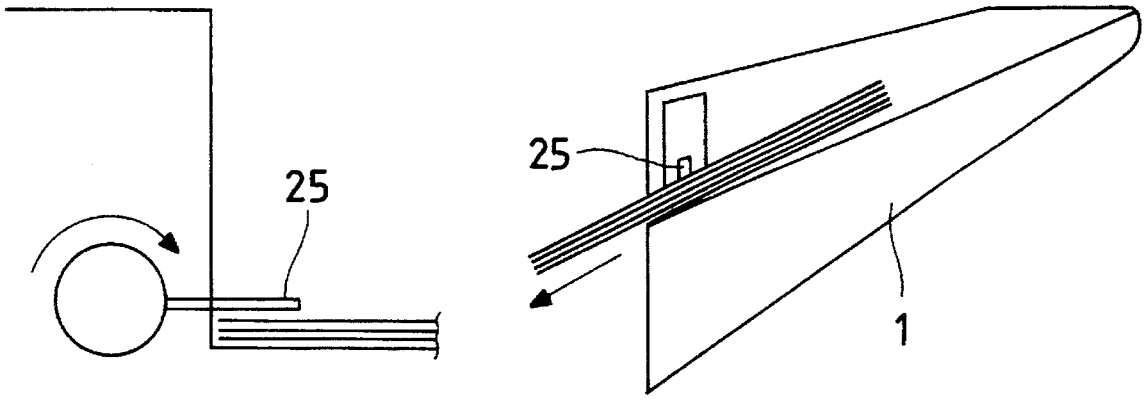
FIG. 2 is a schematic view of a recycle lever disposed on a tray.
Figure 3:
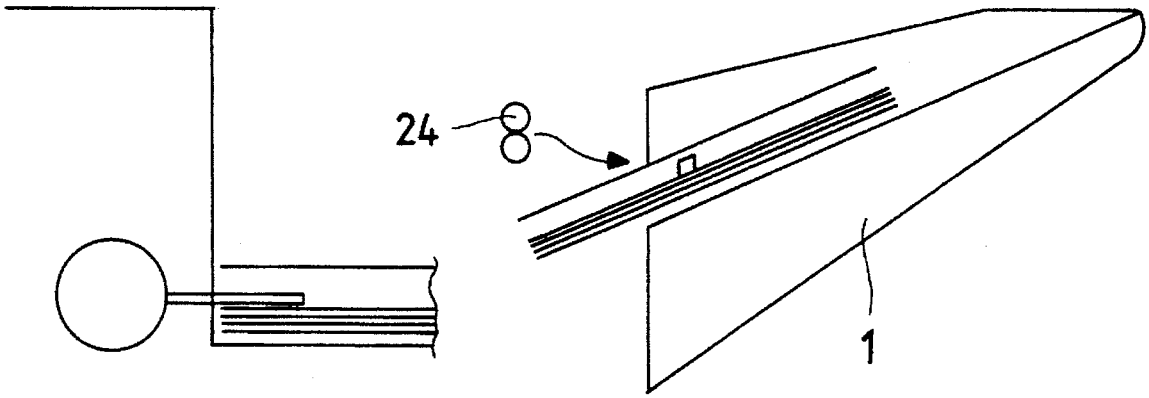
FIG. 3 is a schematic view of another recycle lever disposed on a tray.

First of all, when an operator selects the side-by-side reading mode on an operation portion and depresses a copy key, a first recycle sequence is started, thus counting the number of the originals. Then, a recycle lever 25 (FIG. 2) moves from the back side of the original tray 1 and rides on the original stack S. The originals are counted from the lowermost original while being supplied, and the original circulated (through path I→path II→path III→switchback→path VI) is rested on the recycle lever 25 through the feeding path VI (FIG. 3). After all of the originals are circulated, the recycle lever falls down by its own weight to detect the completion of the circulation of the original stack, thus finishing the counting of the number of the originals. Incidentally, in this first recycle sequence, the copying operation (reading of the originals) is not performed.

Figure 4A:
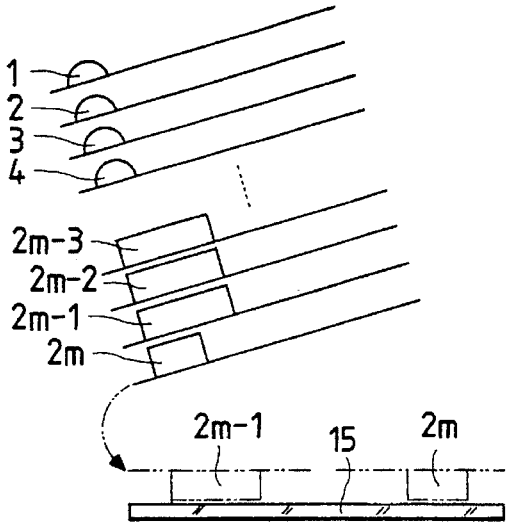
FIGS. 4A to 4E are sequential views for explaining the changing of the page sequence (odd originals)
Figure 4B:
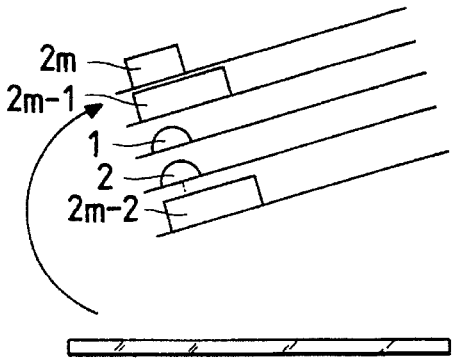
Figure 4C:
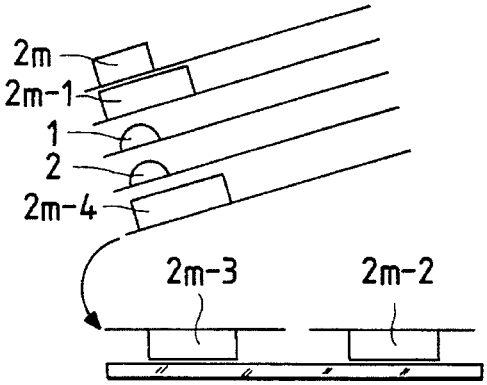
Figure 4D:
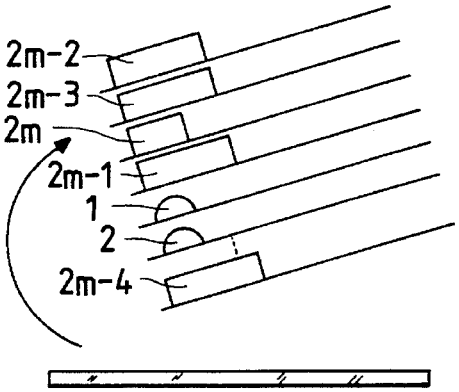
Figure 4E:
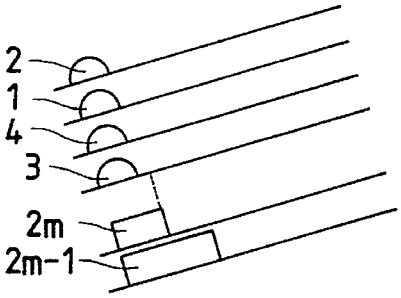
Figure 5A:
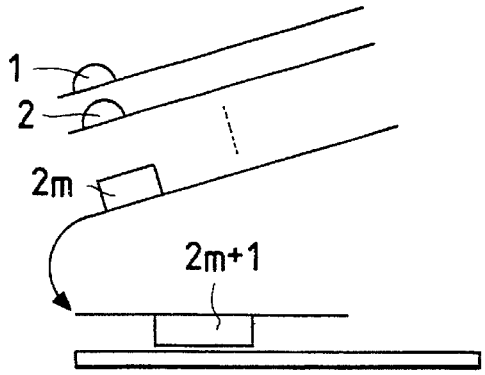
FIGS. 5A to 5E are sequential views for explaining the changing of the page sequence (even originals)
Figure 5B:
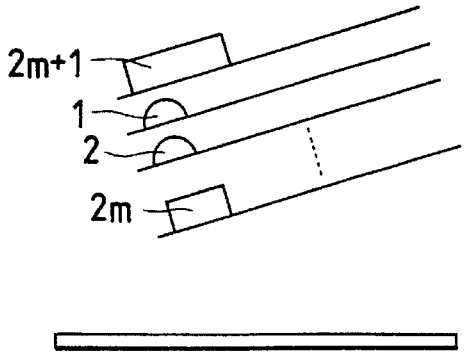
Figure 5C:
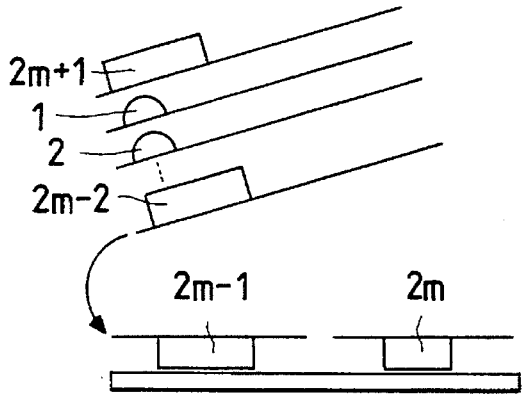
Figure 5D:
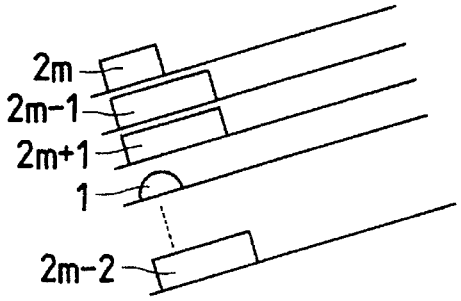
Figure 5E:
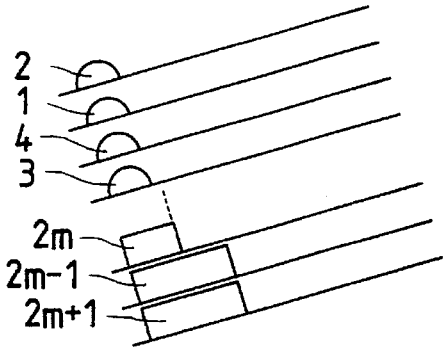

Then, a second recycle sequence is effected. Also in this case, the copying operation is not performed and the replacement of the originals is carried out as described hereinbelow.

i) In the case where the number of the originals is even:

In this case, in the second recycle sequence, the originals are fed two by two onto the platen from the lowermost original in the original stack and are ejected onto the tray as they are. That is to say, when the number of the originals is 2m (m=1, 2, 3, . . .), 2m and (2m−1) originals are firstly fed onto the platen (FIG. 4A) and are ejected (FIG. 4B). Then, 2(m−1) (=(2m−2)) and 2(m−1)−1 (=(2m−3)) originals are fed onto the platen (FIG. 4C) and are re-stacked again (FIG. 4D). By repeating such operation, the originals will be re-stacked as shown in FIG. 4E.

ii) In the case where the number of the originals is odd:

In this case, first of all, only the lowermost original is circulated. Thereafter, the other originals are circulated two by two in the same manner as mentioned above. That is to say, when the number of the originals is 2m+1 (m=1, 2, 3, . . . ), first of all, only (2m+1) original is fed (FIG. 5A) and is ejected (FIG. 5B). Then, 2m and (2m−1) originals are fed (FIG. 5C) and are ejected (FIG. 5D). By repeating such operation regarding originals two by two, the originals will be re-stacked as shown in FIG. 5E.

Figure 6A:
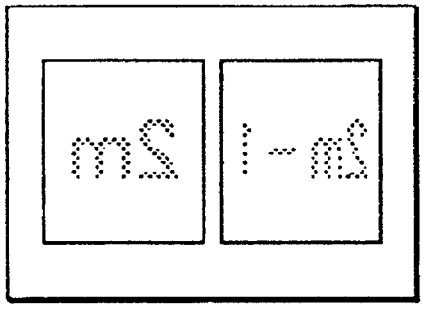
FIGS. 6A and 6B are views showing the relation between originals rested on a platen and a copy obtained.
Figure 6B:
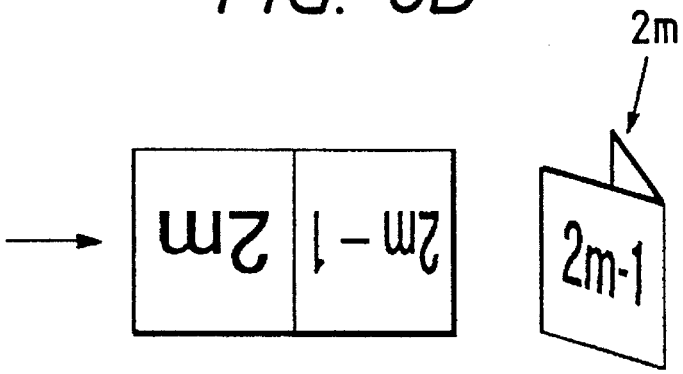
Figure 7A:
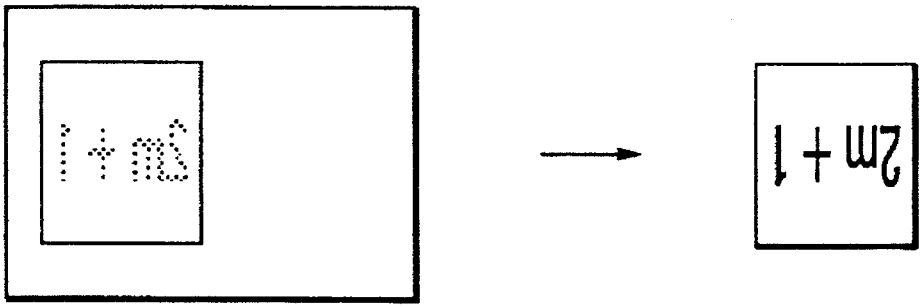
FIGS. 7A and 7B are views showing the relation between an original rested on a platen and a copy obtained.
Figure 7B:
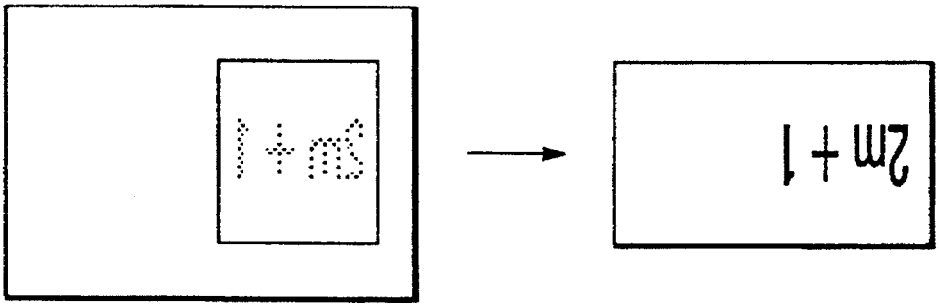

After the replacement of the originals in the second recycle sequence, a third recycle sequence is started. In this third recycle sequence, the actual copying operation is performed to obtain the copy sheets in the side-by-side reading mode.

i) In the case where the number of the originals is even:

In this case, the originals are fed two by two from the lowermost one in the original stack onto the platen with maintaining a predetermined distance (which may be zero or be in a permissible range) between the two originals. That is to say, since the originals are fed two by two from the condition shown in FIG. 4E, the original are rested on the platen as shown in FIG. 6A and the copy sheet as shown in FIG. 6B is obtained. In such an output pattern, the copy sheets can easily be book-bound by folding and stapling them (without disorder of pages). Further, after treatment, the originals ejected on the tray two by two restore the original correct page order.

ii) In the case where the number of the originals is odd:

Similar to the second recycle sequence, first of all, the lowermost original is copied alone. In this case, normally, since the last page original is copied on a transfer sheet of half size (for example, B5 in the A4 letter size), it should be stopped on the platen near the scan reference point and then be copied (FIG. 7A). However, if the copy sheets are folded in two and are book-bound, since the last page original is copied on a transfer sheet of large size, it should be stopped on the platen far from the scan reference point and then be copied (FIG. 7B). Such change in the stop position can be effected by depressing a selection key or on the basis of the operator's selection.

Figure 10:
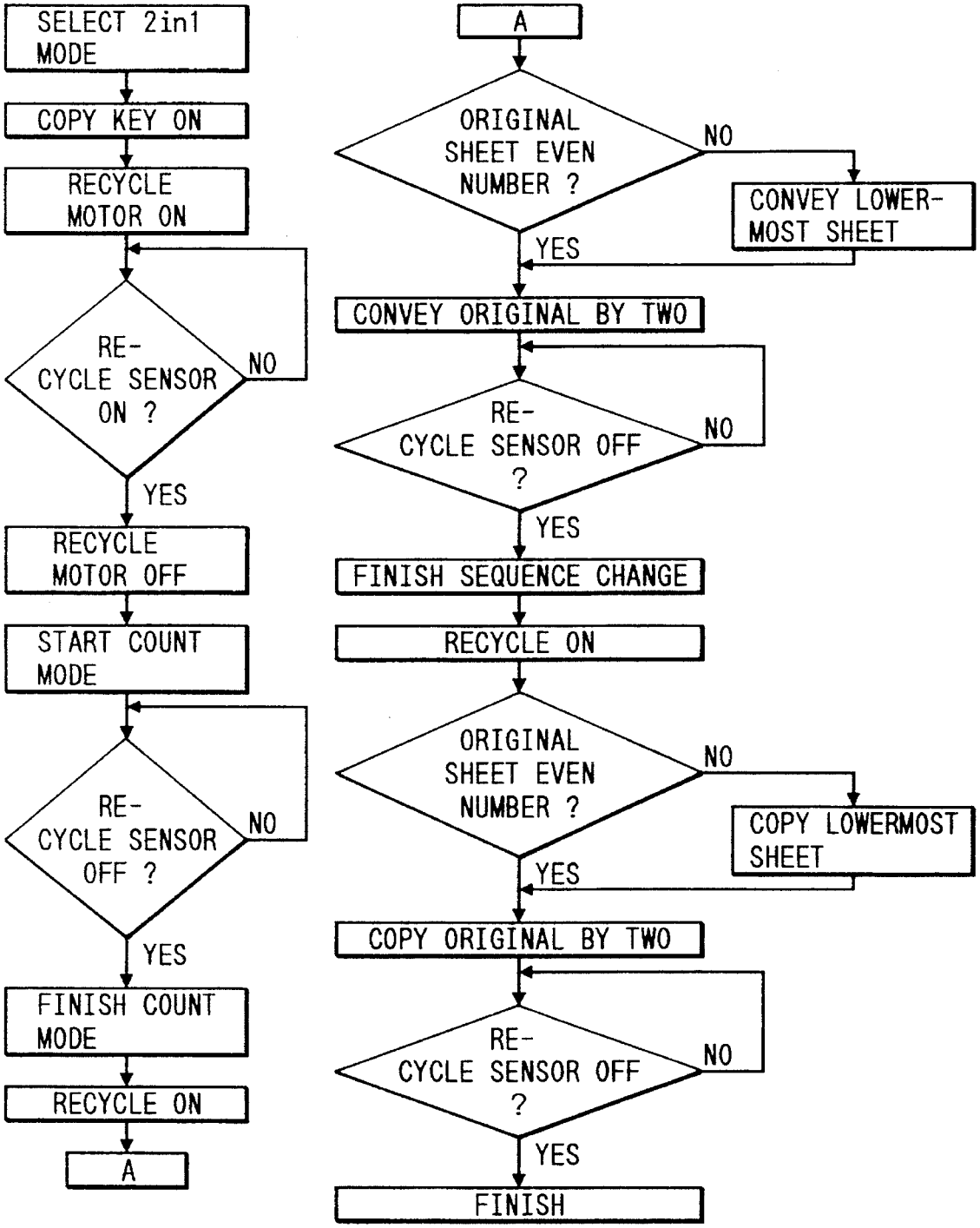
FIG. 10 is a flow chart for explaining a 2 in 1 mode.

After the last page original has been copied alone, similar to the case where the originals are even, the originals are then fed two by two and copied. After all of the originals are ejected, the correct page order will be restored. Such operation is shown in a flow chart of FIG. 10.

Next, a second embodiment will be explained.

In the above-mentioned embodiment, while the three recycle sequences were performed for counting the number of the originals, changing the page sequence in the originals and copying the originals, the following method may be adopted.

Figure 8:
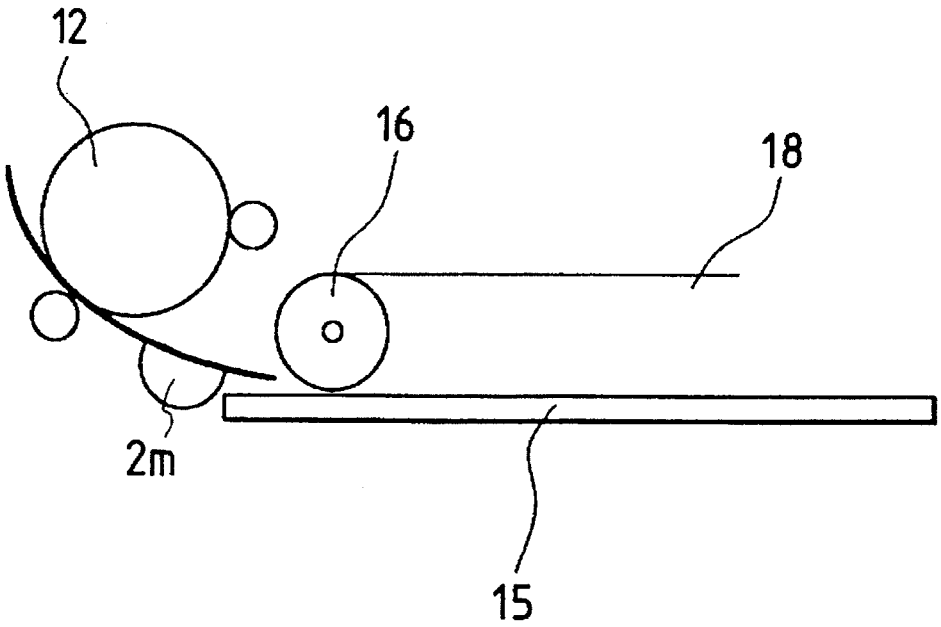
FIG. 8 is a schematic elevational sectional view showing an alteration.
Figure 9:
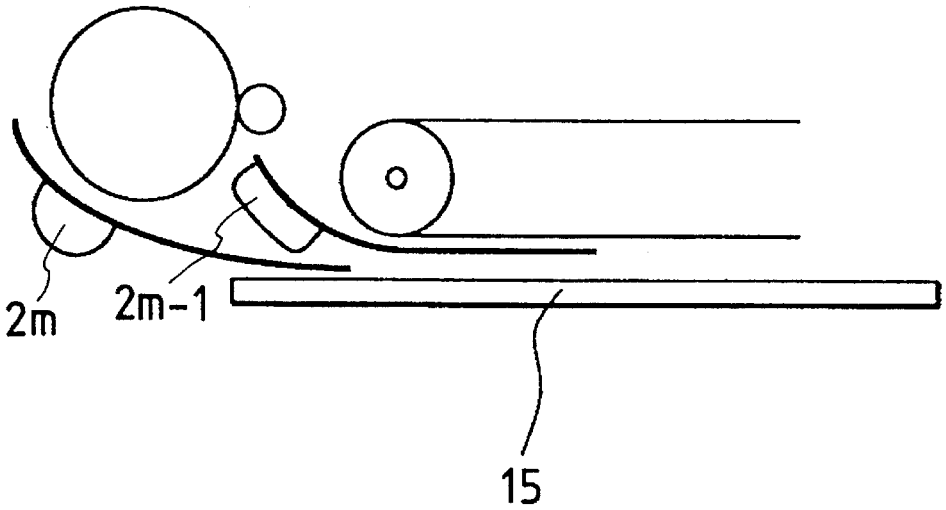
FIG. 9 is a schematic elevational sectional view showing a further alteration.

First of all, the number of the originals are counted in the first recycle sequence. Then, in the second recycle sequence, if the originals are even, after 2m original reaches onto the platen, this original is shifted to the original ejecting direction by rotating the convey belt reversely. When the trailing end of the original passes through the drive roller 16, the original is stopped with remaining the trailing end thereof above the platen area (FIG. 8). Then, (2m−1) original is supplied from the original tray. When the trailing end of (2m−1) original has just reach below the center line of the drive roller 16, the 2m original starts to be fed again toward the platen by rotating the inversion roller 12 reversely, thereby feeding the two original onto the platen concurrently (FIG. 9). After the copying operation, the originals may be ejected as they are. The details will be explained hereinbelow.

First of all, the side-by-side reading mode will be described. When the operator selects the side-by-side reading mode on an operation portion 30 (FIG. 1) via a mode switch 32 (which may be arranged on the original feeding apparatus or on an image treating system) and depresses the copy key, the first recycle sequence is started, thus counting the number of the originals. When the counting of the original number is started, the recycle lever 25 moves from the back side of the original tray 1 and rides on the original stack (FIG. 2). The originals which are fed from the lowermost one and then counted and so circulated pass through the above-mentioned paths and are re-stacked on the recycle lever 25 (FIG. 3). After all of the originals are circulated, the recycle lever falls down by its own weight to detect the completion of the circulation of the original stack, thus finishing the counting of the number of the originals. Incidentally, in the first recycle sequence, the copying operation is not performed. By counting the number of the originals, it is possible to know the total number of the originals, and, thus, to discriminate whether the number of the originals is odd or even.

Figure 11:
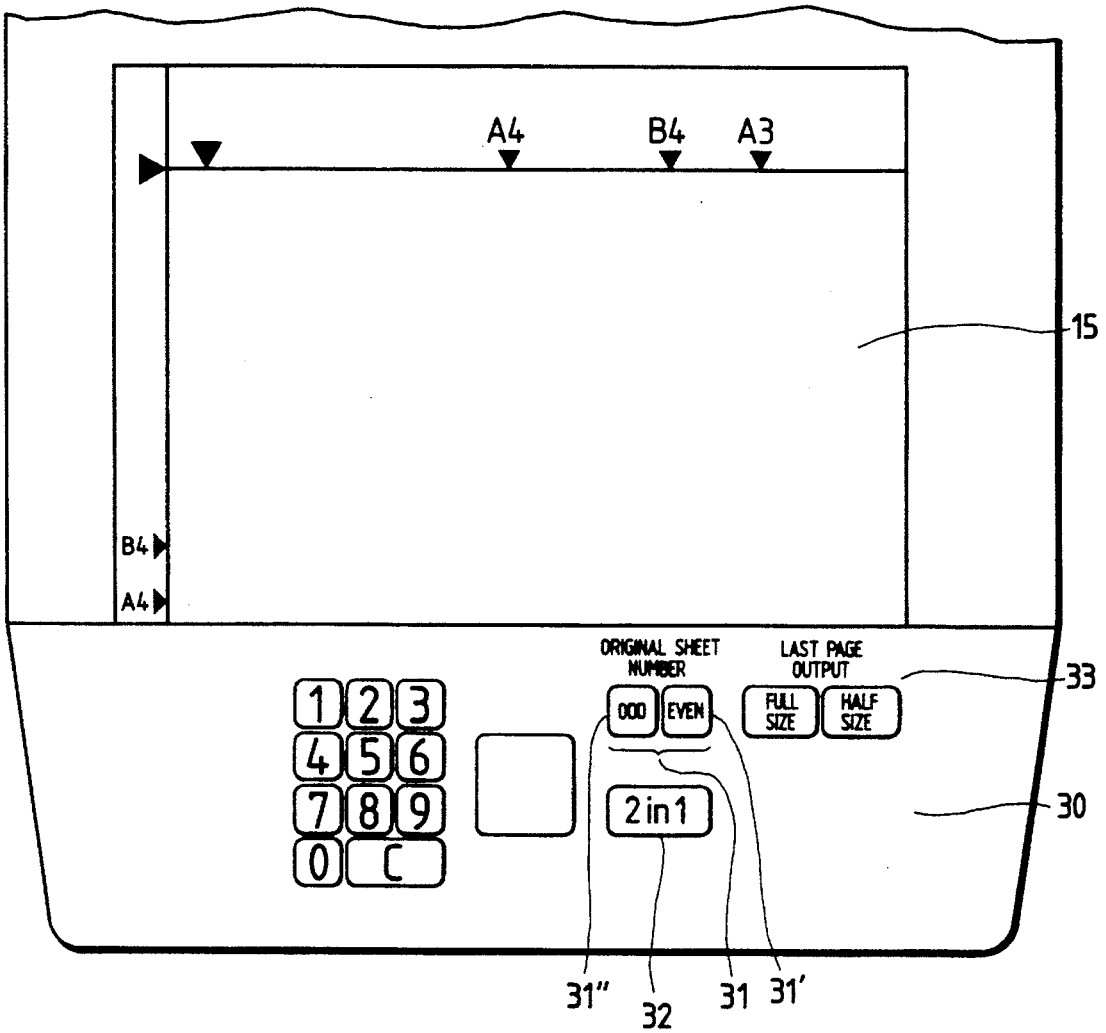
FIG. 11 is a plan view of an operation panel portion according to a second embodiment of the present invention.

As mentioned above, while the odd discrimination was effected by counting the original number, if the number of the originals is not so much, since the operator can easily ascertain the original number, he can input the odd/even discrimination by any other means. FIG. 11 shows the operation portion provided on the image treating system, which operation portion is provided with an original sheet number input key 31 comprising an odd key 31' and an even key 31". By depressing either key 31' or 31", the odd/even discrimination can be inputted to the original treating system.

Figure 12A:
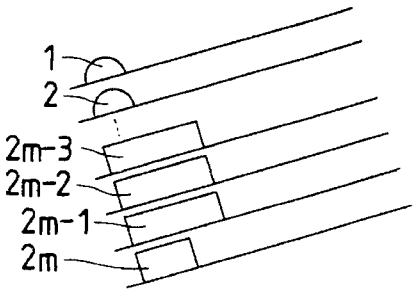
FIGS. 12A to 12F are elevational views for explaining an original feeding operation.
Figure 12B:
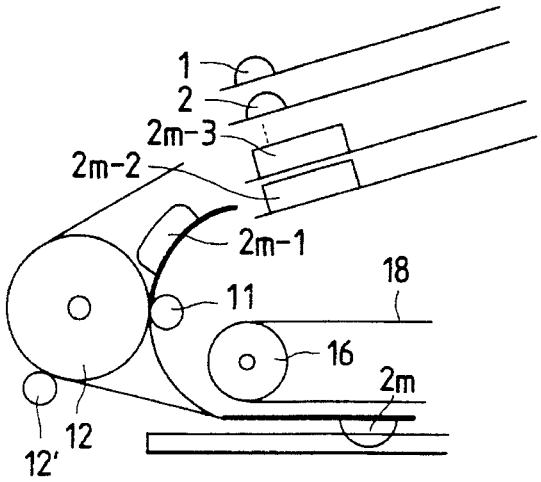
Figure 12C:
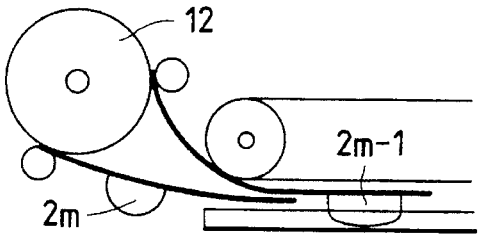

After it has been determined whether the original number is odd or even by the counting of the original number by means of the original treating system or by the input from the operation portion, the copying operation under the side-by-side reading mode is started. Regarding even and odd (original number), the copying operation will be explained hereinbelow.

i) In the case where the number of the originals S is even:

The lowermost original, i.e., 2m original supplied from the original stack S (FIG. 12A) on the original tray is passed through the feeding path II by rotating the inversion roller 12 normally and then is fed onto the platen 15 by rotating the convey belt normally. After the 2m original is set on the platen at the predetermined position, the supplying of (2m–1) original is started. The (2m–1) original is fed by the normal rotation of the inversion roller 12 until the leading end of this original enters into the regist nip (FIG. 12B). Then, the 2m original on the platen 15 is ejected into the feeding path VI by the reverse rotation of the convey belt 18, and, when the 2m original is pinched by the inversion roller 12 and a roller 12', the reverse rotation of the convey belt 18 is stopped (FIG. 12C). At the same time, the (2m–1) original pinched in the regist nip is further fed by the normal rotation of the inversion roller 12 until the leading end of this original reaches above the platen 15. Accordingly, the pinching of the leading end of the 2m original by means of the roller 12' urged against the inversion roller occurs substantially at the same time as the introduction of the leading end of the (2m–1) original above the platen (FIG. 12C).

Figure 12D:
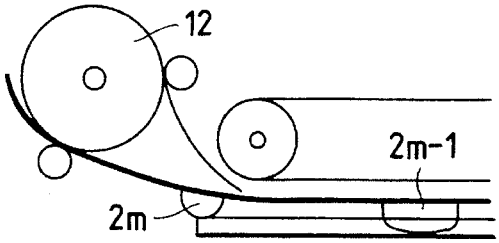
Figure 12E:
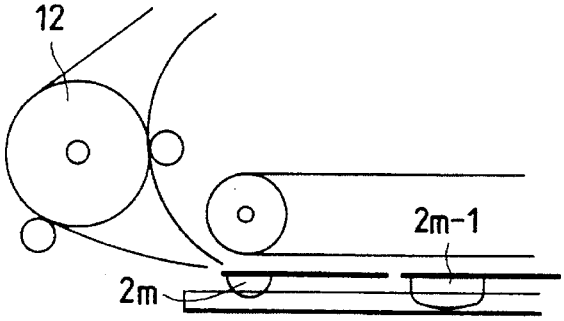
Figure 12F:
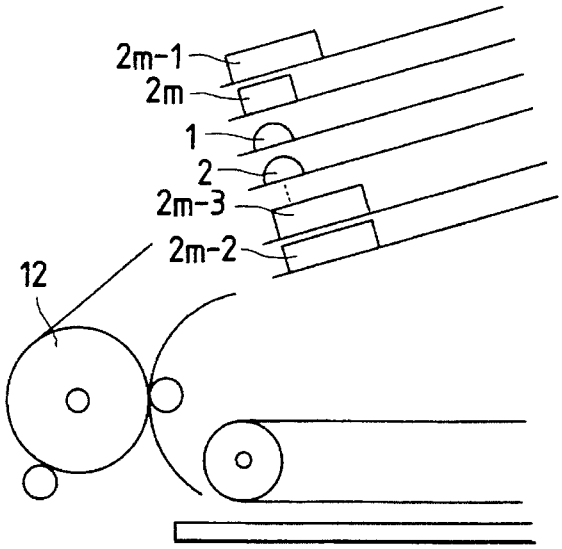

Further, the inversion roller 12 is rotated normally and the convey belt 18 is changed to be rotated normally. When the trailing end of the 2m original reaches near an edge of the platen 15, the normal rotation of the inversion roller 12 is stopped. At this point, the trailing end of the (2m–1) original is substantially aligned with the leading end of the 2m original on the platen (FIG. 12D). In this case, since a feeding force of the inversion roller becomes stronger than that of the convey belt, the 2m original pinched between the inversion roller 12 and the roller 12' is not fed toward the platen by the normal rotation of the convey belt 18.

Figure 13A:
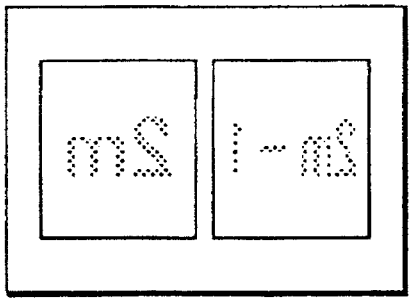
FIGS. 13A and 13B are views showing the relation between originals rested on a platen and a copy obtained.
Figure 13B:
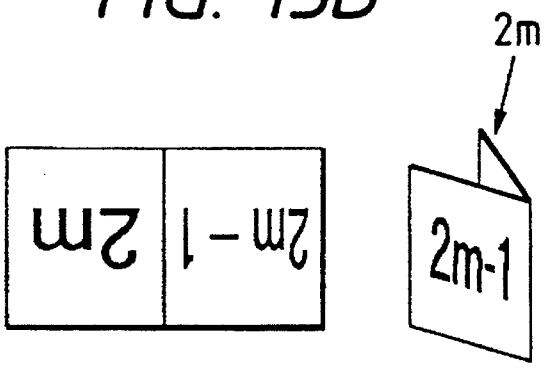
Figure 14A:
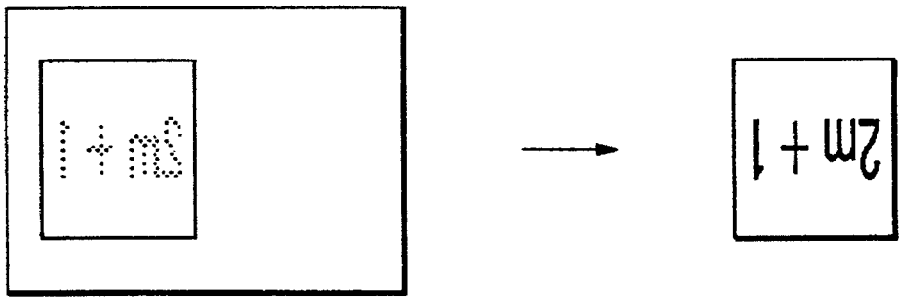
FIGS. 14A and 14B are views showing the relation between an original rested on a platen and a copy obtained.
Figure 14B:
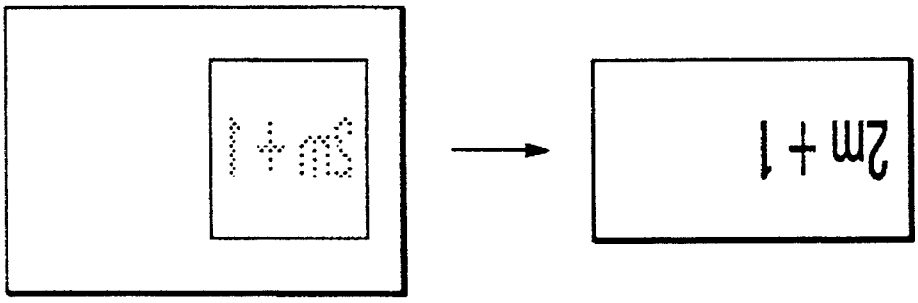
Figure 15:
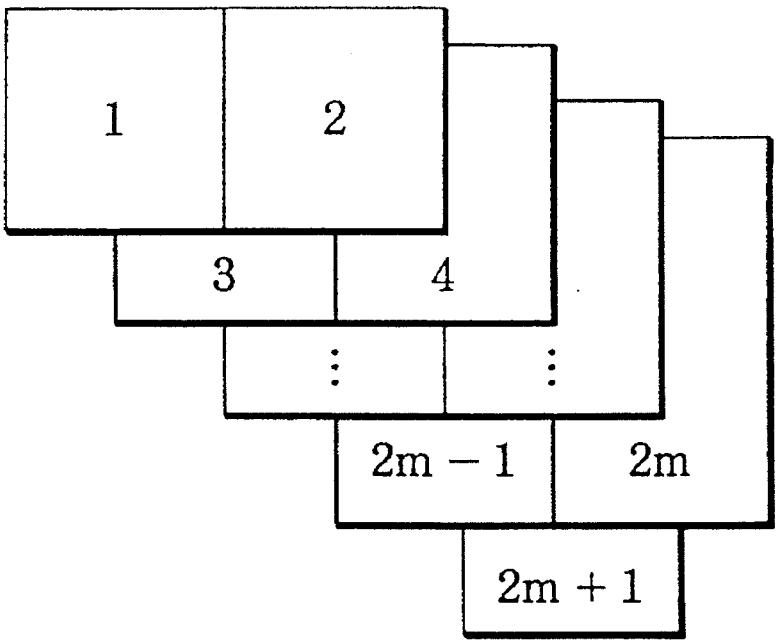
FIG. 15 is a plan view showing the relation between original rested on a platen and copies obtained.
Figure 16:
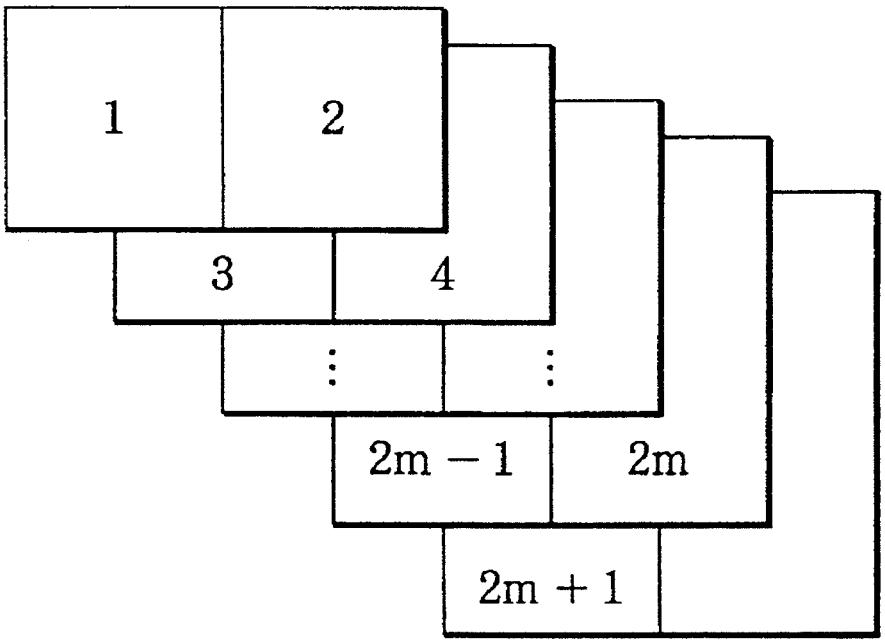
FIG. 16 is a plan view showing the relation between originals rested on a platen and copies obtained.

Then, the normal rotation of the convey belt 18 and the reverse rotation of the inversion roller 12 are simultaneously started, so that the 2m and (2m–1) originals are rested on the platen 15 at the predetermined position while maintaining the relation between these originals as shown in FIG. 12D. In this case, since the originals are fed two by two from the lowermost one in the condition as shown in FIG. 12A to perform the above-mentioned replacement of the originals, the positional relation between the originals on the platen 15 will be as shown in FIG. 13A, and the copy sheet as shown in FIG. 13B will be obtained. With this output pattern, the copy sheets can easily be book-bound by folding and stapling them (without disorder or pages). Further, after treatment, the originals ejected on the tray two by two restore the original correct page order.

ii) In the case where the number of the originals is odd:

First of all, the lowermost original is copied alone. In this case, normally, since the last page original is copied on a transfer sheet of half size (for example, B5 in the A4 letter size), it should be stopped on the platen near the scan reference point (FIG. 7A). Thus, a bundle of copy sheets as shown in FIG. 15 can be obtained. However, when the copy sheets are folded in two and are book-bound, since the last page original is copied on a transfer-sheet of large size, it should be stopped on the platen far from the scan reference point Ba (FIG. 20) and then be copied (FIG. 14B). Thus, a bundle of copy sheets as shown in FIG. 16 can be obtained.

Such change in the stop position can be effected by depressing the selection key or a last page output patter input key 33 arranged on the operation portion 30. Alternatively, for example, on the basis of size information from cassettes 100, 102 (described later), when the transfer sheets of half size are set in the cassette, the original may be automatically stopped at the stop position near the scan reference point and the transfer sheet of half size may be automatically be selected (FIG. 14A), and, when there is no half size transfer sheet, the original may automatically be stopped at the stop position far from the scan reference point and the image may be copied on the transfer sheet of large size (FIG. 14B).

Figure 17:
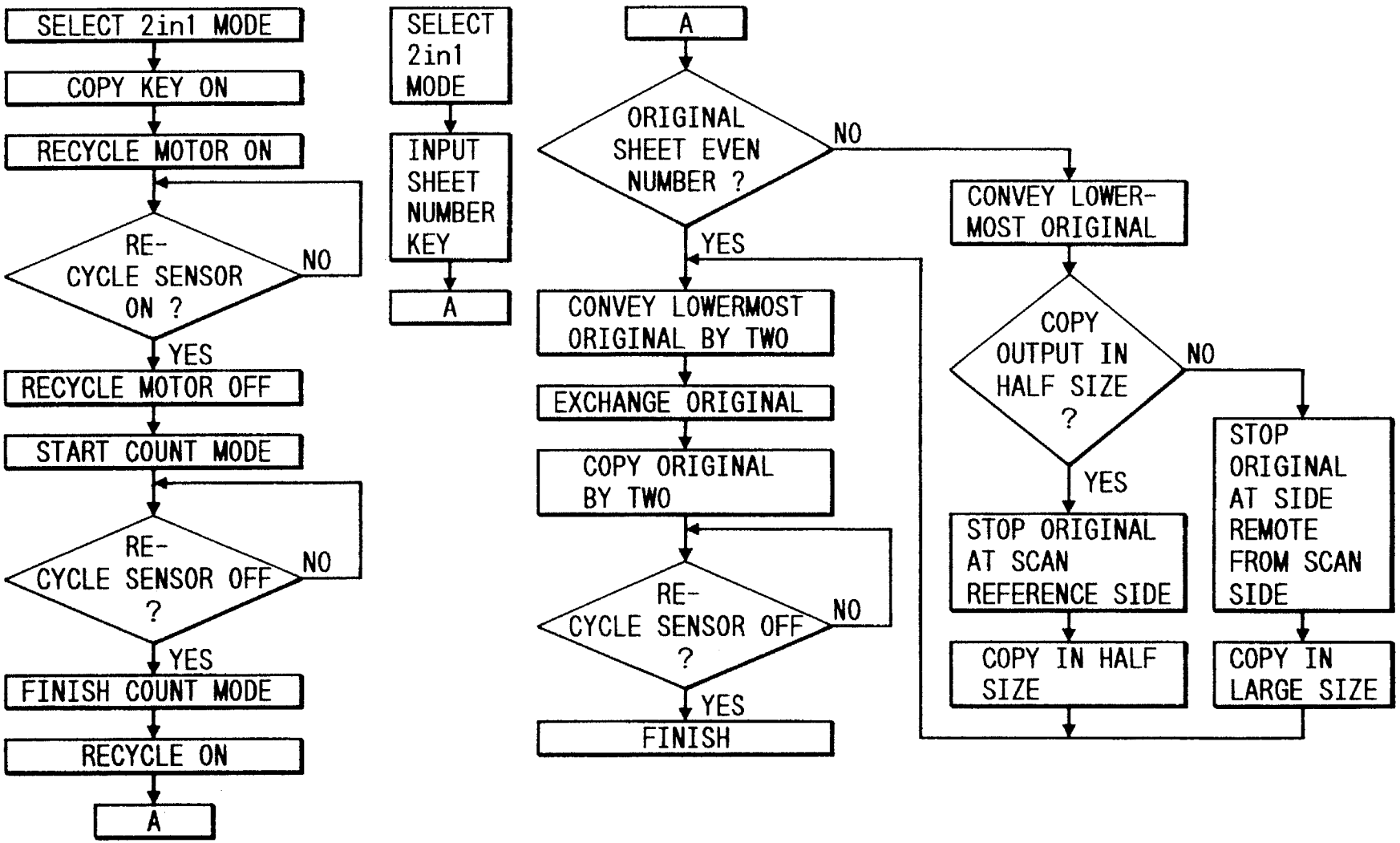
FIG. 17 is a flow chart for explaining a 2 in 1 mode, according to the second embodiment.

After the last page original has been copied alone, similar to the case where the originals are even, the originals are then fed two by two and copied. After all of the originals are ejected, the correct page sequence will be restored. Such operation is shown in a flow chart of FIG. 17.

Next, a third embodiment will be explained.

Figure 18:
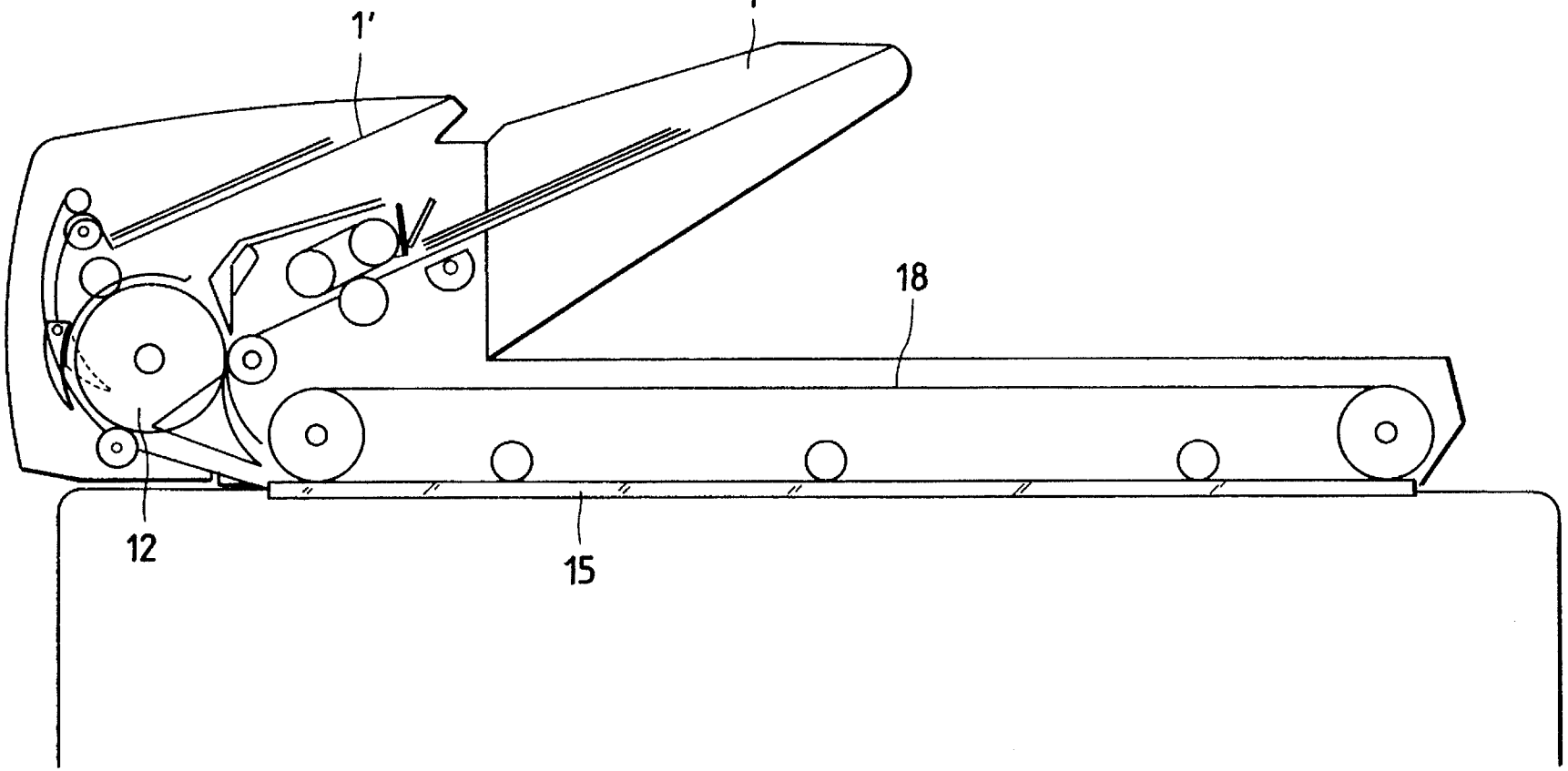
FIG. 18 is an elevational sectional view showing a third embodiment of the present invention.

In the above-mentioned embodiment, while the original treating system of the recycle type wherein the treated originals are re-stacked on the non-treated originals was explained, as shown in FIG. 18, the present invention may be carried out by an original feeding apparatus wherein the treated originals are ejected onto an ejection tray 1' which is provided independently of the original tray 1 on which the non-treated originals are stacked. Incidentally, with this arrangement, the odd/even discrimination regarding the original number is effected only by the operator's input to the operation portion.

Figure 19:
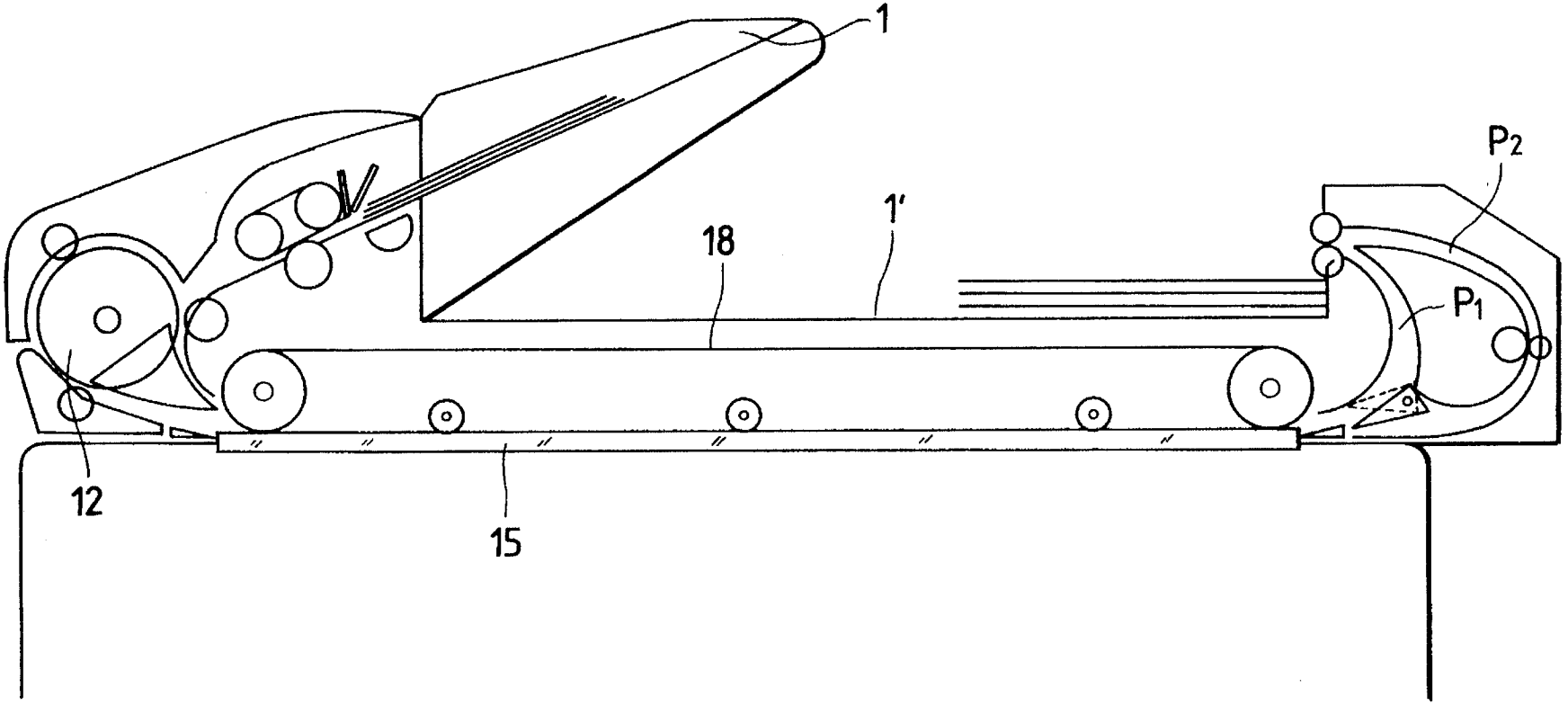
FIG. 19 is an elevational sectional view showing a fourth embodiment of the present invention.

In the embodiment shown in FIG. 18, while the treated originals were ejected from a side same as a side at which the originals are fed onto the platen, as shown in FIG. 19, the treated originals may be ejected from a side opposite to a side at which the originals are fed onto the platen. In this case, since the page sequence is varied if the treated originals are ejected onto the ejection tray as they are, it is necessary to replace the page sequence before the two originals are ejected onto the ejection tray (between the platen and the ejection tray). This is accomplished by providing a buffer path $P_2$ independently of a normal original ejecting path $P_1$, by temporarily waiting the (2m–1) original in the baffer path $P_2$, by ejecting 2m original through the normal path $P_1$ previously, and by ejecting the (2m–1) original onto the 2m original ejected on the ejection tray 1'.

Next, the whole construction of a copying machine will be explained with reference to FIG. 20. While an original feeding apparatus 130 incorporated into this copying machine has a different construction from that shown in FIG. 1, it can be controlled similarly.

Figure 20:
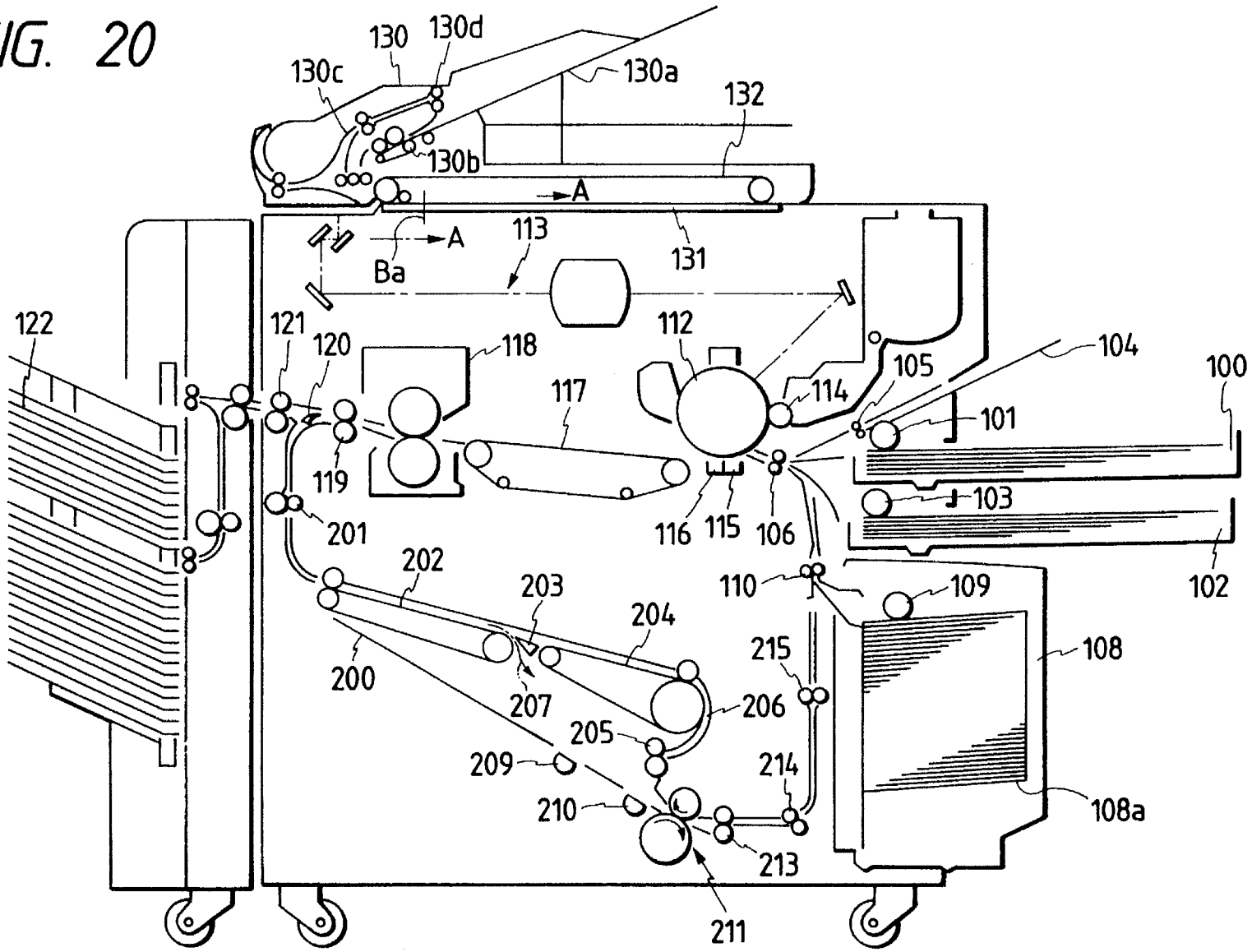
FIG. 20 is an elevational sectional view showing the whole copying machine.

In FIG. 20, sheets stacked in an upper cassette 100 are separated and fed one by one by means of a separating pawl and a sheet supply roller 101. The separated sheet is directed to a pair of regist rollers 106. A sheet inserted from a manual sheet supply guide 104 can be fed to the paired regist rollers 106 via a pair of rollers 105. A sheet stacking device (of deck type) 108 is provided with an intermediate plate **108*a* lifted and lowered by means of a motor and the like, and sheets stacked on the intermediate plate are separated and fed one by one by a supply roller 109 and a separating pawl. The separated sheet is directed to a convey roller 110**.

An image forming portion is constituted by a photosensitive drum 112, an optical reading system 113, a developing device 114, a transfer charger 115 and a separation charger 116.

Incidentally, the reference numeral 117 denotes a conveyor belt for conveying the sheet on which an image was formed; 118 denotes a fixing device; 119 denotes convey rollers; and 120 denotes a flapper. The sheet on which the image was formed is directed to a pair of ejector rollers 121 by means of the flapper 120 and then is sent to a sorter 122. The sorter 122 has non-sort trays 122*a*, sort bin trays 122*b*, non-sort tray ejector rollers 122*c* and sort bin tray ejector rollers 122*d*, so that the sheets are sorted one by one by lifting and lowering the non-sort trays and the sort bin trays. Incidentally, in place of the sorter, an ejection tray may be used.

The automatic original feeding apparatus 130 includes a tray 130*a*, a separating means 130*b*, a return path 130*c* and a pair of ejector rollers 130*d*. By using this apparatus, the originals are positioned on a platen 131 one by one. The original set on the platen is read by the optical reading system 113. A convey belt 132 can reversibly be rotated, so that the original is directed onto the platen by the normal rotation (shown by the arrow A) thereof and the original is ejected from the platen by the reverse rotation thereof.

Regarding one original rested on the platen, images are formed on the photosensitive drum repeatedly dependent upon the set copy number, and the sheet is fed from either the cassette 100, 102 or the deck 108 to the photosensitive drum whenever each image is formed on the photosensitive drum. The registration between the image on the photosensitive drum and the sheet is effected by the paired regist rollers 106. When the required number of copies are obtained, the original is ejected from the platen, and a next original is positioned on the platen. Thereafter, the same operations are repeated.

An intermediate tray 200 serves to temporarily stock the sheets on which the image was formed, when the images are desired to be formed on both surface of the sheet or when the images are desired to be superimposed on a single surface of the sheet (multi-print). The reference numeral 201 denotes convey rollers; 202 denotes a conveyor belt; 203 denotes a flapper; 204 denotes a conveyor belt; and 205 denotes convey rollers. In the both-surface copy, the sheet is directed to the intermediate tray 200 through a path 206. In this case, the image surface of the sheet is faced upwardly. In the multi-print copy, the sheet is directed to the intermediate tray 200 through a path 207. In this case, the image surface of the sheet is faced downwardly.

The sheets stacked on the intermediate tray 200 are separated and re-fed one by one from the lowermost one by means of auxiliary rollers 209, 210 and a pair of reversible separation rollers 211. The re-fed sheet is directed to the image forming portion via convey rollers 213, 214, 215, paired rollers 110 and paired regist rollers 106. After the image has been formed on the sheet, such sheet is ejected as mentioned above.

Regarding one original rested on the platen, each image is copied on one surface of a corresponding sheet. This sequence is repeated by times depending upon the set copy number. These sheets are stacked on the intermediate tray 200. Thereafter, the original is ejected from the platen and is again directed to the platen with the surface upside down. Then, the image on the back surface of the original is read by times depending upon the set copy number. The read image is formed on the sheet fed from the intermediate tray 200 whenever the reading is effected. Thereafter, the sheets are sorted in the sorter 122 with page sequence.

Figure 21:
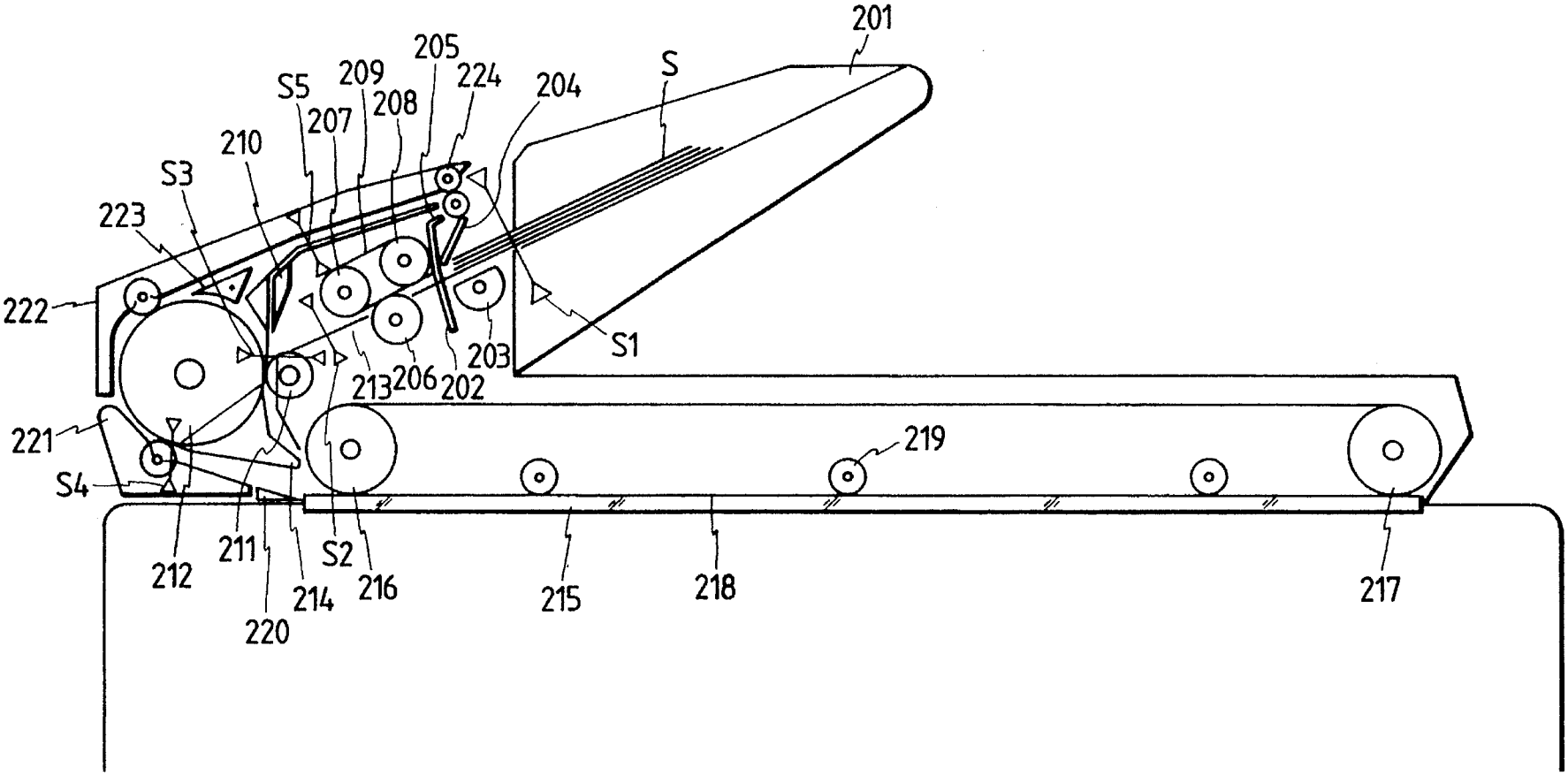
FIG. 21 is an elevational sectional view of a recycle document feeder (RDF), i.e., a recycle original feeding apparatus according to an example (utilizing an inversion path), for carrying out the present invention.

On the other hand, there is a method wherein a set of copies can be obtained whenever all of the originals are circulated once by the automatic original feeding apparatus. According to this method, even when a plurality of copy sets are desired, since a copy set with proper page sequence can be obtained, it is possible to obtain a required number of copy sets without any sorter. When the both-surface copying operation is effected by using this method, the images on both surfaces of a single original are sequentially read and are sequentially copied on both surfaces of a single sheet. Then, the images on both surfaces of a next original are sequentially read and are sequentially copied on both surfaces of a next sheet. By repeating such operations, it is possible to obtain the sorted both-surface copies. FIG. 21 shows a recycle original feeding apparatus according to a further embodiment (utilizing an inversion path) of the present invention.

Briefly explaining, a stack of originals S can be housed in an original tray 201. The reference numeral 202 denotes an original stopper against which leading ends of the originals are abutted. A semi-circular roller 203 is associated with the leading end of the original and serves to supply a lowermost original from the tray. When the original is hard to be introduced into a separating portion, a weight 204 can fall on the original stack S to urge the original stack against the semi-circular roller 203 and to aid the supplying of the original. A separation regulating plate 205 serves to prevent the original stack S from entering into the separating portion at a time. A sheet supply roller 206 cooperates with a pair of separating rollers 207, 208 and a separating belt 209 to separate the lowermost original from the original stack. A leading end portion of an upper guide 210 is designed so that the original can easily be entered into a regist nip between a regist roller 211 and an inversion roller 212. An inner guide 213 and an intermediate guide 214 form an original feeding path and serve to direct the original onto a platen 215. The original is fed to the platen 215 by means of a convey belt 218 extending between a drive roller 216 and a turn roller 217, and a plurality of small rollers 219 for pressurizing the belt from inner side thereof. After the copying operation, the convey belt 218 is rotated reversely, so that the original is fed to a path formed between a lower guide 221 and the intermediate guide 214, via a jump member 220. Thereafter, the original is further fed through a space between an openable guide 222 and the inversion roller 212 and then passes through above a flapper 223 and the upper guide 210 to reach a pair of ejector rollers 224 by which the original is ejected onto the ejection tray 201.

Incidentally, in the both-surface copying operation, the flapper 223 is deflected so that the original can pass below the flapper and is fed again onto the platen by means of the regist roller 211 and the inversion roller 212.

Next, an arrangement of sensors will be explained. Between the inversion roller and the ejector rollers, there are disposed an empty sensor S1 for detecting the presence/absence of the original on the original tray, a separation sensor S2 arranged at a downstream side of the separation nip, a regist sensor S3 arranged at an upstream side of a nip between the resist roller 211 and the inversion roller 212, an inversion sensor S4 arranged in an inversion path from the platen, and an ejection sensor S5 for carrying out the speed control during the ejecting of the sheet.

Next, a driving force transmitting mechanism for driving various rollers will be explained.

Figure 22:
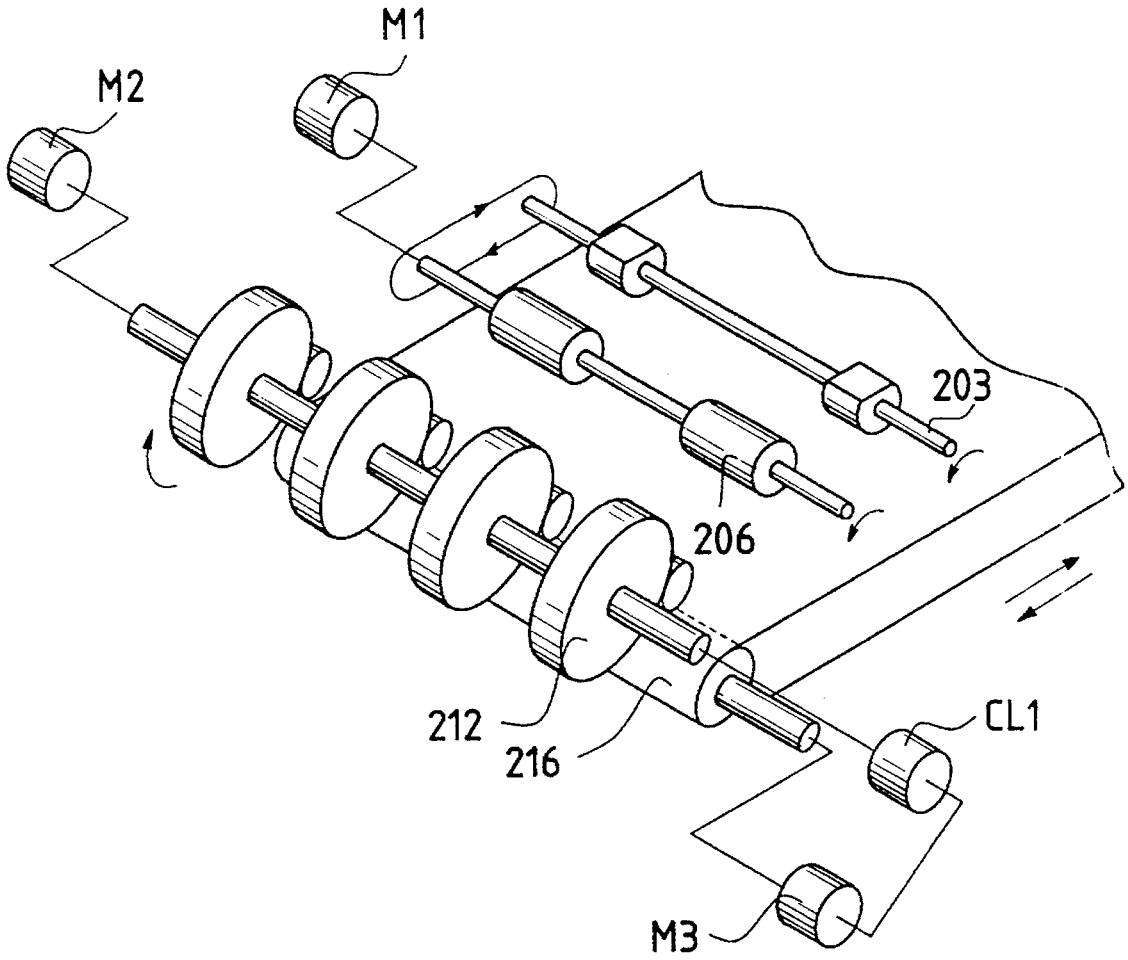
FIG. 22 is a perspective view of a driving force transmitting mechanism of the RDF of FIG. 21.

As shown in FIG. 22, this mechanism comprises a separation motor M1 for driving the semi-circular roller 203 and the supply roller 206, a convey motor M2 for driving the inversion roller, a belt motor M3 for driving a drive shaft 216 for driving the convey belt 218, and a clutch CL1 for synchronizing the inversion roller 212 and the drive shaft 216. These motors and clutch are governed by a constrol system (not shown).

Next, various operations in connection with each mode will be briefly described.

SINGLE-SURFACE MODE

Step 1 (Sheet Supply)

While the empty sensor S1 is in an ON condition, when the start key on the image forming system (not shown) is depressed, the separation motor M1 is activated to feed the lowermost original m to the separating portion. After the original passes through the regist sensor S3 through the separating portion, the original is further fed by a predetermined distance until the leading end of the original is abutted against the nip between the inversion roller and the regist roller. Now, the separation motor is turned OFF. After a predetermined time period has been elapsed, the clutch CL1 is turned ON and the belt motor M3 is also turned ON, thus directing the original to the platen. After a predetermined time period has been elapsed from the time when the trailing end of the original has just pass through the regist sensor S3, the belt motor M3 and the clutch CL1 are turned OFF, thus positioning the original on the platen at the reference point.

Step 2 (Sheet Replacement and Sheet Ejection)

During the image forming operation regarding the previous original, the next original (m−1) is waiting at a position where the leading end thereof is abutted against the nip between the inversion roller and the regist roller. After the image forming operation, the belt motor M3 is reversed to feed back the original m by a predetermined distance until the trailing end thereof is abutted against the nip between the inversion roller and the follower roller. Now, the belt motor M3 is turned OFF. Then, the clutch and the convey motor are turned ON and the belt motor is rotated normally, thus directing the original m into the ejection path and, at the same time, resting the next original (m−1) on the platen in the same manner as the Step 1. The original m is guided toward the ejector rollers by means of the flapper 223 deflected by a solenoid (not shown) and then is re-stacked on the tray. In this case, the original can be stably ejected by performing the speed control every time whenever a predetermined time is elapsed after the leading end of the original has passed through the ejection sensor.

BOTH-SURFACE MODE

Step 1 (Sheet Supply)

(Same as the above Step 1.)

Step 2 (Sheet Inversion)

Then, the belt motor M3 is reversed to feed back the original m by a predetermined distance until the leading end of the original is abutted against the nip between the inversion roller and the follower roller. Now, the belt motor is turned OFF. Then, the clutch is turned ON and the belt motor is rotated normally, with the result that the original m is again directed to the nip between the inversion roller and the regist roller by means of the flapper 223 deflected by the solenoid (not shown). The belt motor M3 is further rotated until the original is shifted by a predetermined distance after the trailing end thereof has passed through the regist sensor S3. Then, the belt motor M3 and the clutch CL1 is turned OFF, thus resting the original on the platen at the reference point to prepare for the image formation of a back surface of the original.

Step 3

(Similar to the Step 2, the original is rested on the platen to prepare for the image formation of the front surface of the original.)

Step 4 (Sheet Replacement and Sheet Ejection)

(Same as the Step 2 in the SINGLE-SURFACE MODE.)

SIDE-BY-SIDE READING MODE

Step 1 (Sheet Supply)

(Same as the Step 1 in the SINGLE-SURFACE MODE.)

Step 2 (Inversion)

(Same as the Step 2 in the BOTH-SURFACE MODE.)

Step 3 (Synchronous Feeding)

Figure 23A:
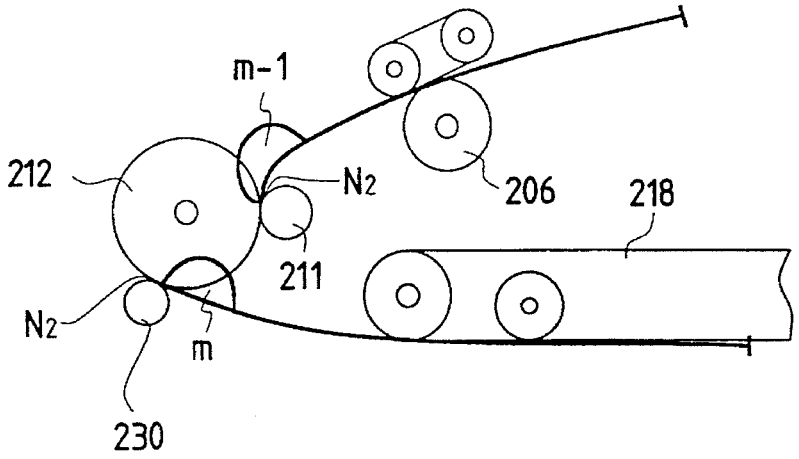
FIGS. 23A to 23E are schematic elevational sectional views showing the flow of sheets in the RDF of FIG. 21.
Figure 23B:
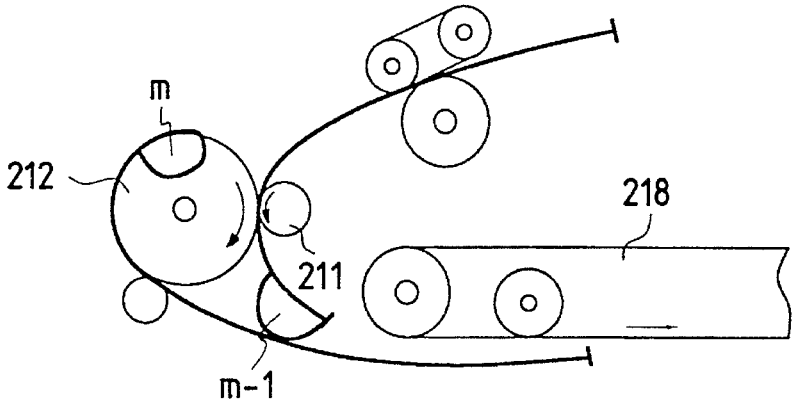

A next original (m−1) is fed to the regist nip (nip N1) between the inversion roller 212 and the regist roller 211 in the Step 1 by means of the separation motor M1 (FIG. 23A). Then, the belt motor M3 is reversed, with the result that the original m is fed by a predetermined distance until the leading end thereof is abutted against the nip (nip N2) between the inversion roller 212 and the follower roller 230. Now, the belt motor M3 is turned OFF (FIG. 23A). Then, the clutch is turned ON and the belt motor is rotated normally, thus feeding the originals m and (m−1) in synchronous with each other (FIG. 23B).

Figure 23C:
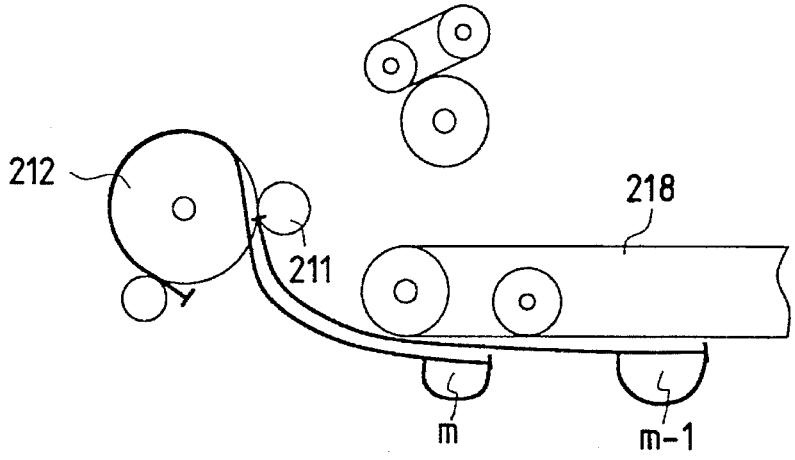

After the belt motor M3 is rotated by a predetermined amount so that the trailing end of the original (m−1) reaches immediately at the downstream side of the nip between the inversion roller 212 and the regist roller 211, the belt motor and the clutch are turned OFF (FIG. 23C). In this case, an overlap amount L between the original m and the original (m−1) is determined by an equation L=11−12+2 which is obtained by subtracting a distance 12 between the nips N1 and N2 from the original size 11 and adding a slip amount 2 of the original (m−1) at the nip N1.

Figure 23D:
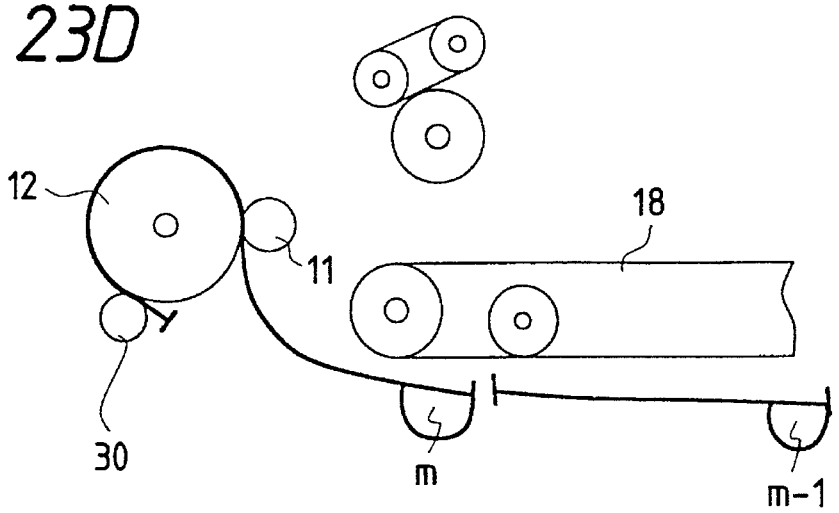
Figure 23E:
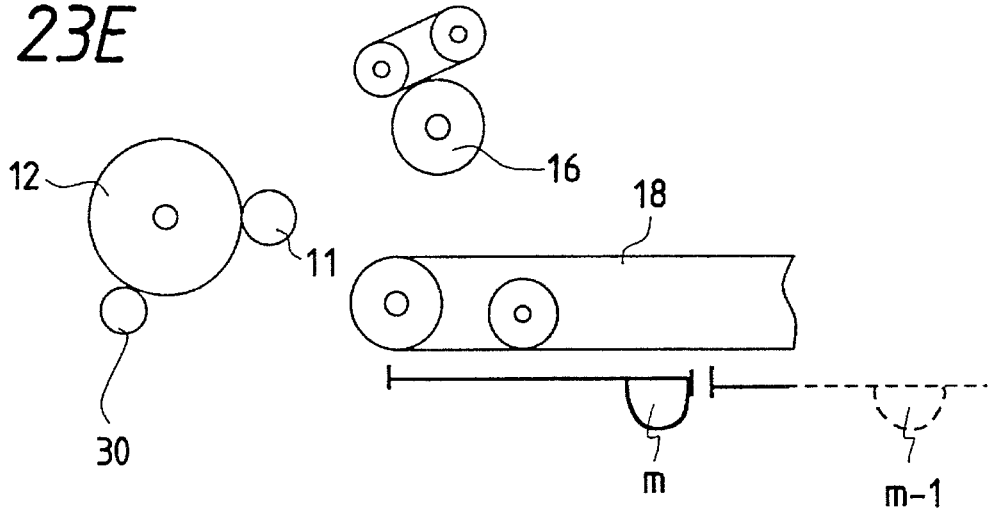

Thereafter, by rotating the belt motor M3 by an amount corresponding to the overlap amount L and then stopping the same, only the original (m−1) is fed while holding the original m by the inversion roller, with the result that two originals are rested in such a manner that the leading end of the original m is aligned with the trailing end of the original (m−1) (FIG. 23D). Then, the clutch is turned OFF and the belt motor is rotated normally, thus feeding the originals m and (m−1) in synchronous with each other. The belt motor is further rotated until the original m is further fed by a predetermined distance after the trailing end thereof has passed through the regist sensor, thus resting the originals m and (m−1) on the platen. Now, the clutch and the belt motor are turned OFF (FIG. 23E).

Step 4 (Synchronous Sheet Ejection)

After the image formation, the belt motor is rotated reversely by an amount corresponding to the original size, and then is stopped. On the other hand, the convey motor is also turned ON so that the original m is fed toward the ejector rollers by the inversion roller 212. After the trailing end of the original m has passed through the ejection sensor and the original is ejected completely, the belt motor is again rotated reversely to direct the original (m−1) to the inversion roller. After a predetermined time period has been elapsed, the belt motor is turned OFF. Then, after the trailing end of the original (m−1) has passed through the ejection sensor and the original is ejected completely, the convey motor is turned OFF. Further, at the completion of the ejection of the original m, the original (m−1) may be fed to the nip N1 to perform the sequence in the same manner as the SINGLE-SURFACE MODE.

Next, an example utilizing the inversion path will be explained.

Figure 24:
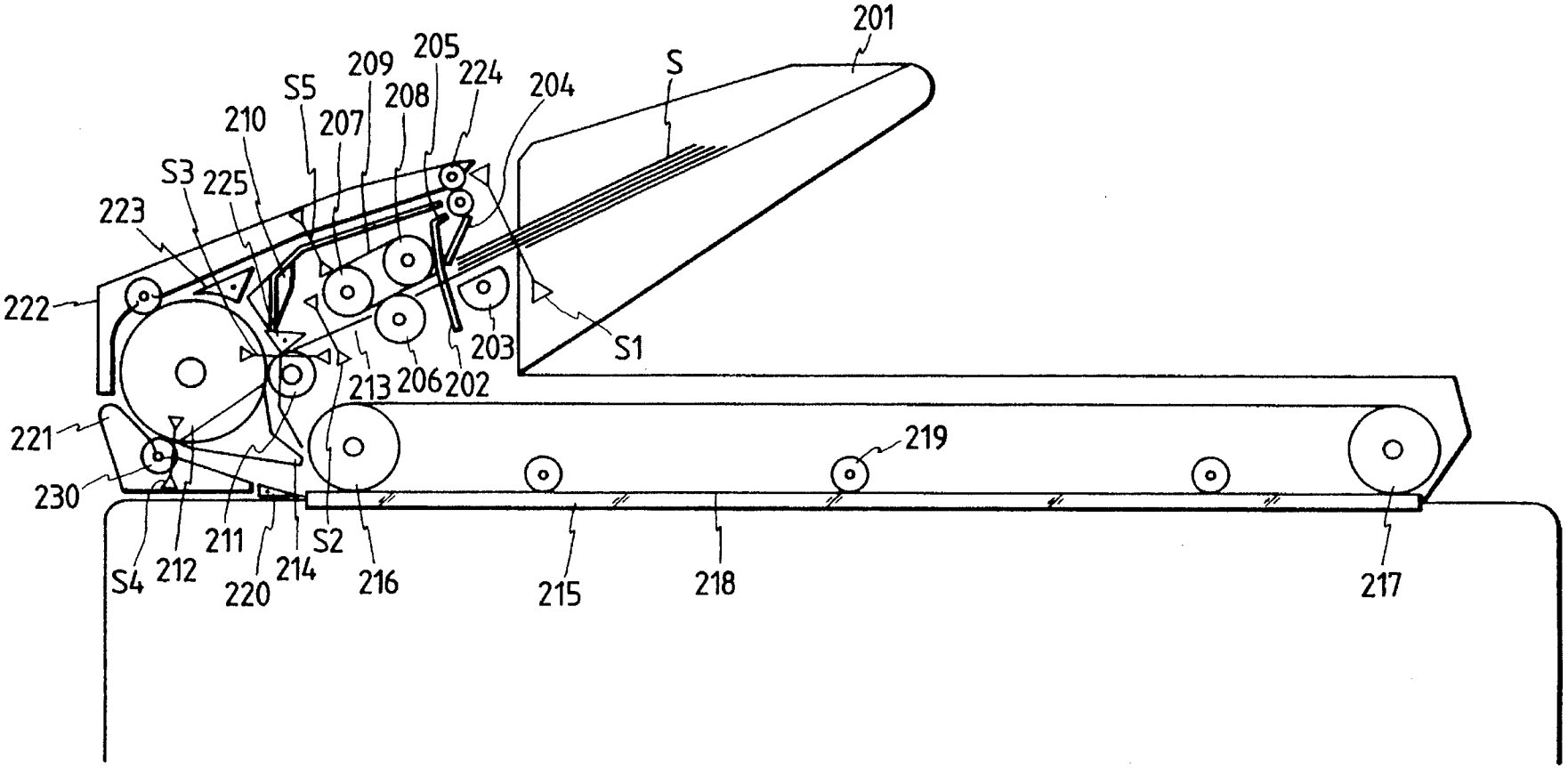
FIG. 24 is an elevational sectional view of a recycle document feeder (RDF) according to another example (utilizing an inversion path), for carrying out the present invention.

Fundamentally, this example is similar to the embodiment shown in FIG. 21, except that a flapper 225 is added and the jump member 220 can be deflected as shown in FIG. 24. Regarding the single-surface mode and the both-surface mode, the explanation thereof will be omitted, since they are the same as those in the previous embodiment. Thus, the side-by-side copying mode will be described hereinafter.

Step 1 (Original m Retard)

Figure 25A:
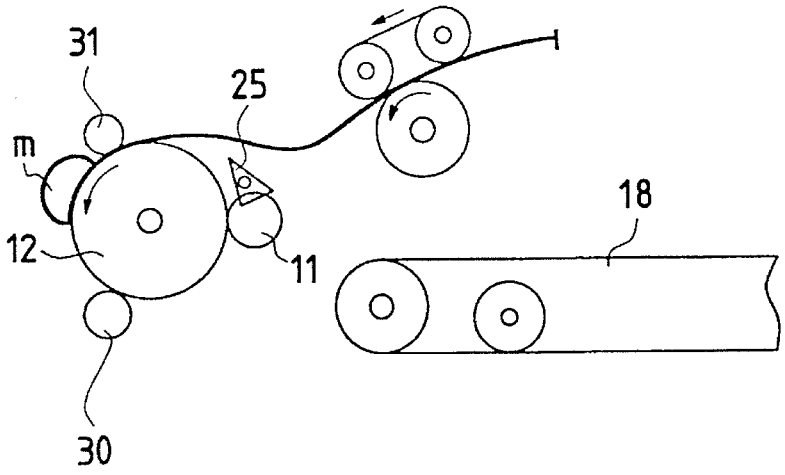
FIGS. 25A to 25F are schematic elevational sectional views showing the flowing of sheets in the RDF of FIG. 24.
Figure 25B:
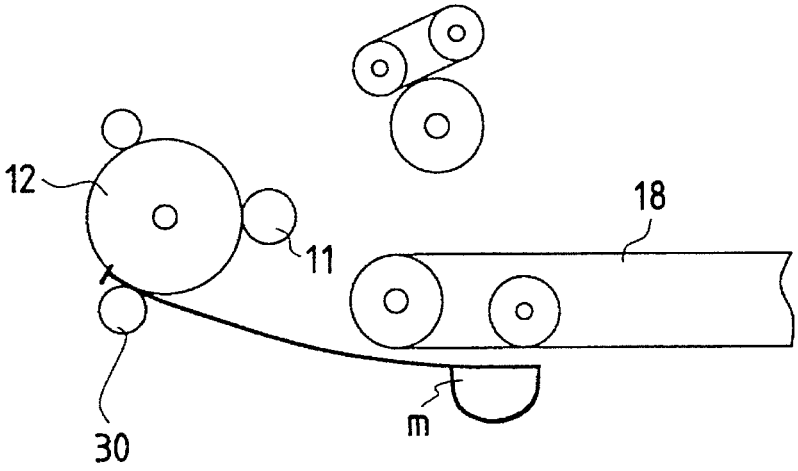

While the empty sensor S1 is in the ON condition, when the start key (not shown) is depressed, the separation motor M1 is activated for a predetermined time period to feed the lowermost original m to the separating portion. At the same time, the flapper 225 is deflected for a predetermined time period by a solenoid (not shown) (normally, forming a guide surface required in the single-surface mode or in the both-surface mode), so that the separated original m is directed to the flapper 223. At the same time, the convey motor is rotated reversely, thus pinching the original between the inversion roller 212 and the follower roller 231 (FIG. 25A). Further, the inversion roller 212 continues to rotate. After the leading end of the original m has passed through the inversion sensor, the jump member 220 is deflected, thus directing the leading end of the original m between the convey belt 218 and the platen 215. At the same time, the belt motor is turned ON, thus advancing the original. The convey motor and the belt motor are stopped immediately before the trailing end of the original m passes through the nip between the inversion roller 212 and the follower roller 230. (FIG. 25B)

Step 2 (Original (m−1) Supply)

Figure 25C:
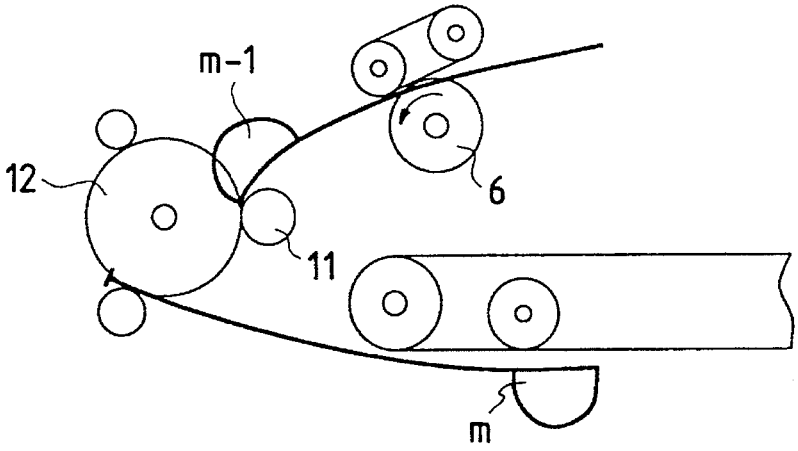
Figure 25D:
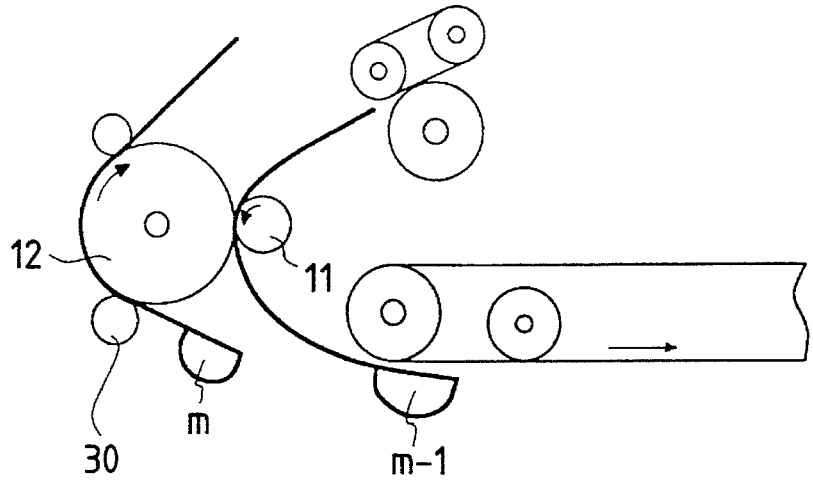
Figure 25E:
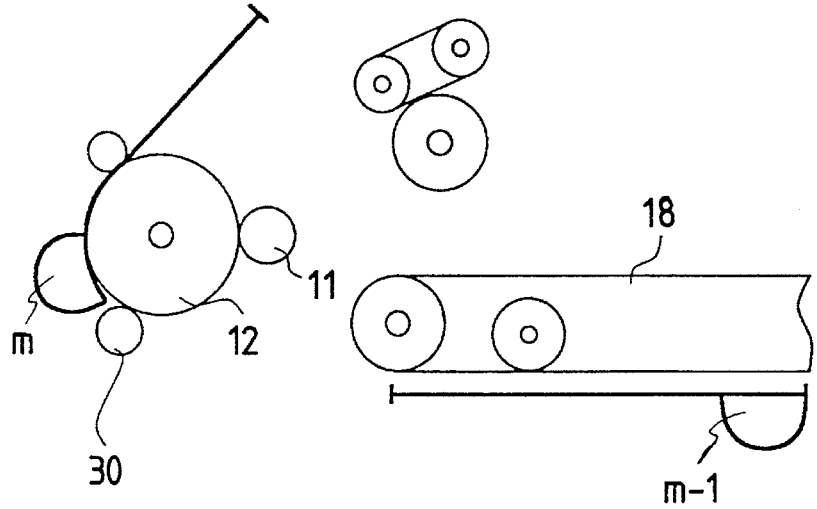
Figure 25F:
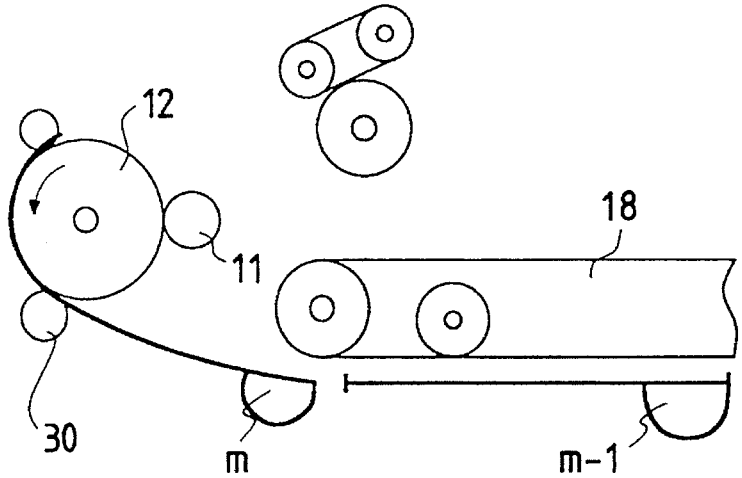
Figure 26:
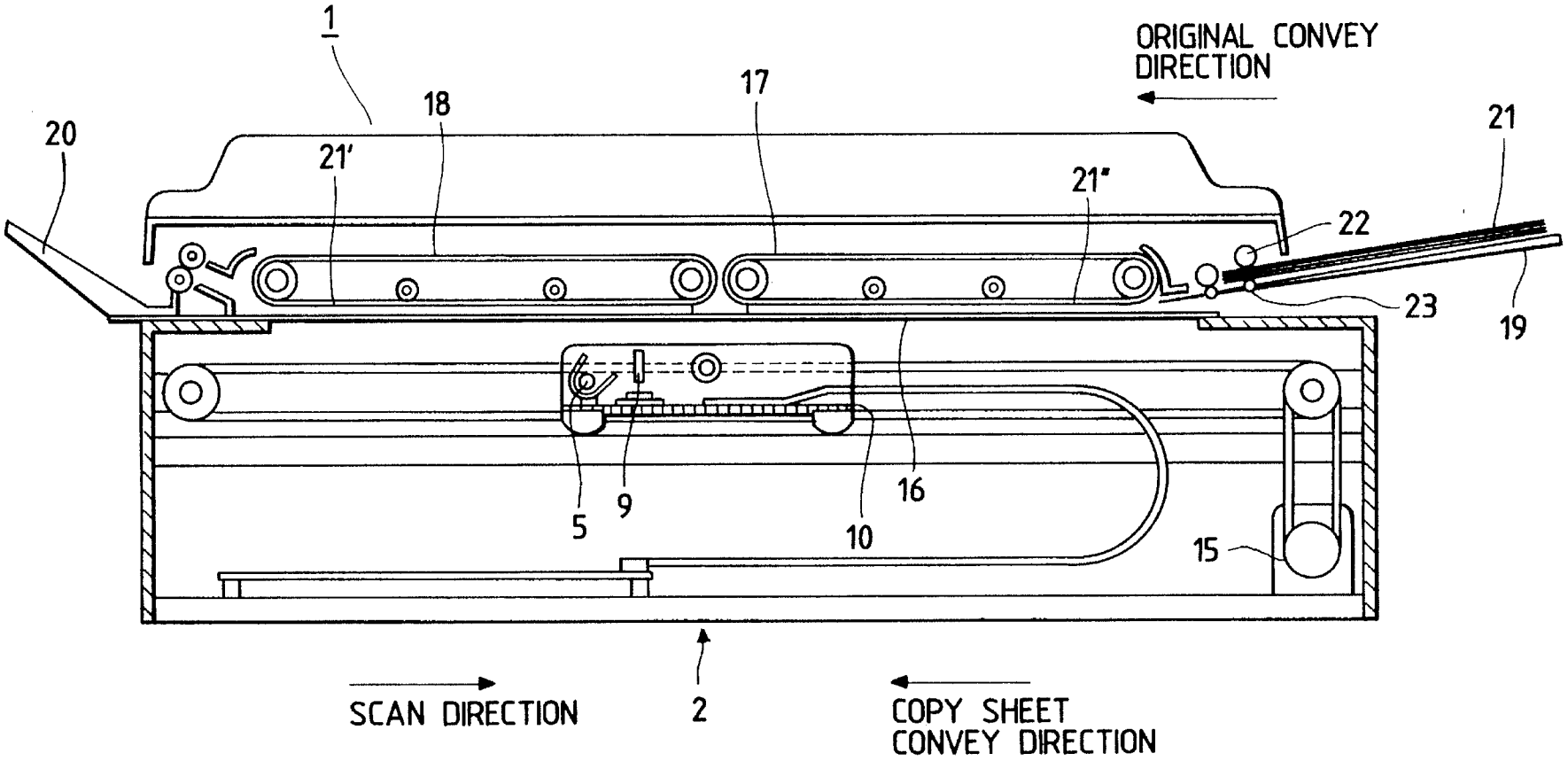
FIG. 26 PRIOR ART
FIG. 26 is an elevational sectional view of a conventional original feeding system.
Figure 27A:
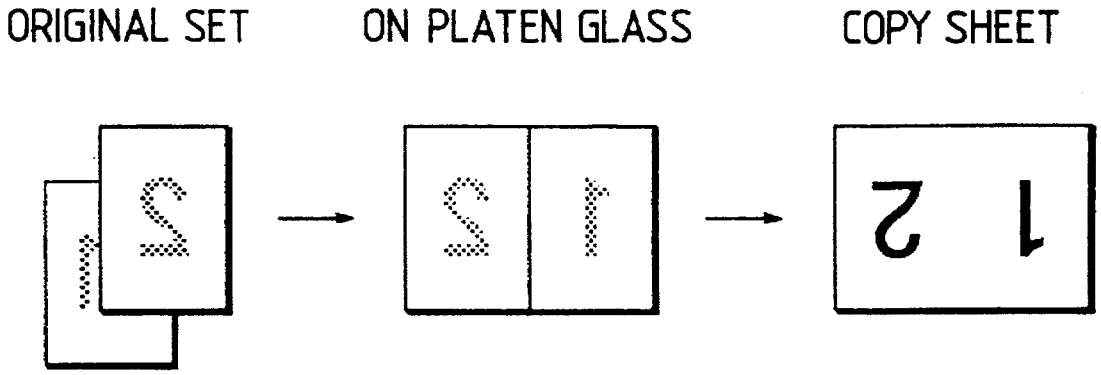
FIG. 27A PRIOR ART
FIGS. 27A and 27B are views showing the relation between the original set, originals rested on a platen and a copy obtained.
Figure 27B:
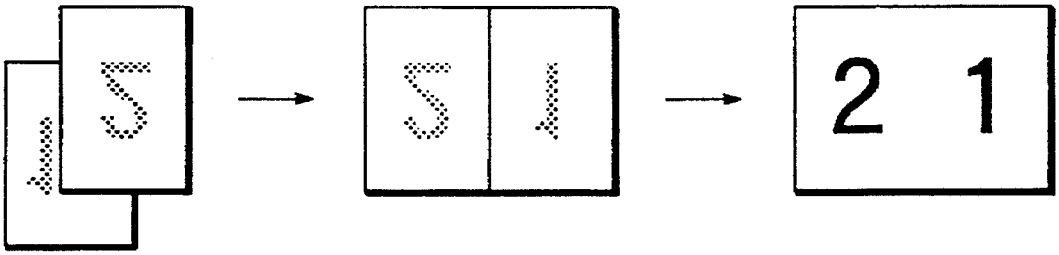
FIG. 27B PRIOR ART
Figure 28:
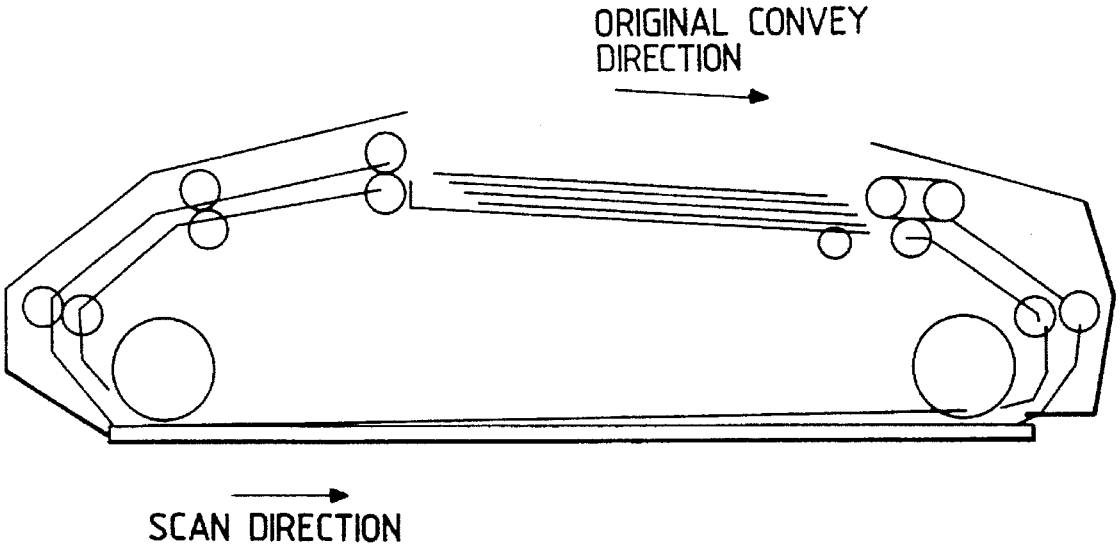
FIG. 28 is an elevational sectional view of another conventional original feeding system.
Figure 29:
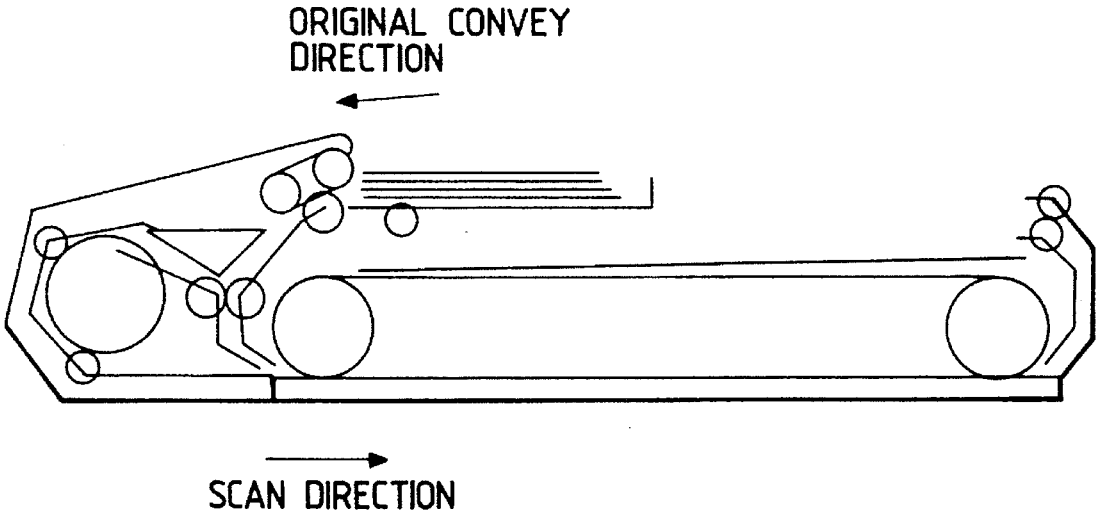
FIG. 29 is an elevational sectional view of a further conventional original feeding system.
Figure 30:
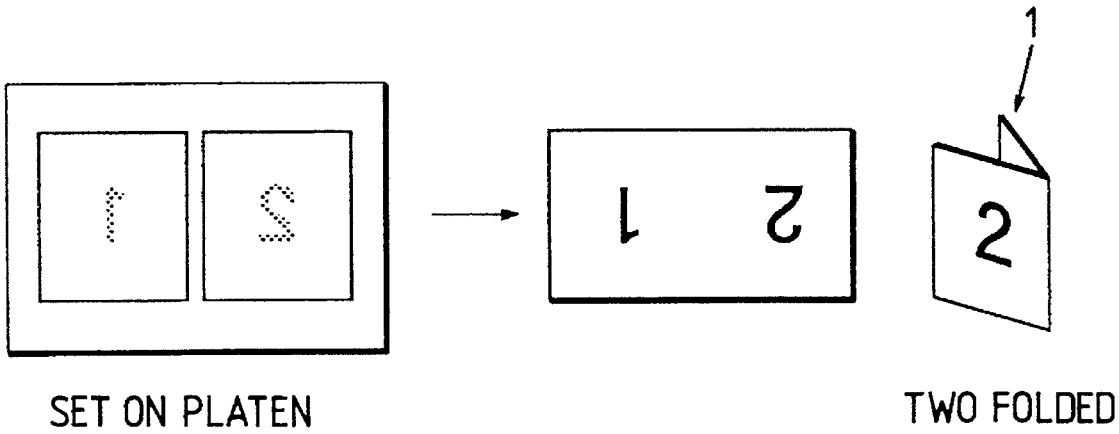
FIG. 30 is a view showing the relation between originals rested on a platen and a copy obtained.
Figure 31:
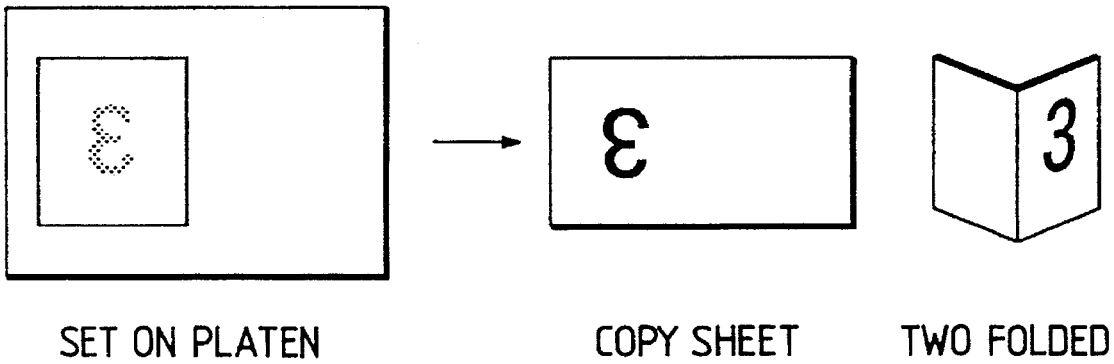
FIG. 31 is a view showing the relation between an original rested on a platen and a copy obtained.

Then, the original (m−1) is abutted against the nip between the inversion roller 212 and the regist roller 211 (FIG. 25C). Then, the clutch is turned ON and the belt motor is rotated normally, thereby feeding the original (m−1) onto the platen and retarding the original m from the platen (FIG. 25C ). When the trailing end of the original (m−1) has passed through the regist sensor S3 and has just passed through the nip N1, the clutch is turned OFF and the inversion roller is stopped. On the other hand, by further feeding the original (m−1) by a predetermined distance from the regist sensor, this original is rested on the platen at the predetermined reference point. Then the belt motor is turned OFF (FIG. 25E). Thereafter, the convey motor is again rotated reversely and the jump member is also deflected, with the result that the original m is conveyed until the leading end of the original m reaches a predetermined distance from the inversion sensor S4 (distance between sensor and the left end of the original resting position on the platen) (FIG. 25F). Then, the belt motor and the convey motor are turned ON, thus resting the original m on the predetermined position.

Since the ejection sequence is the same as the previous one, the explanation thereof will be omitted.

What is claimed is:

1. An original feeding method for resting a plurality of stacked originals on a platen side-by-side by using a recycle original feeding apparatus having a tray, the originals being fed from a stack of originals comprising a plurality of sets, each set including at least two originals, said method comprising the steps of:

(a) replacing an initial page sequence of a set of originals by (i) resting the set of originals in the initial page sequence from the tray on said platen within the set, and then (ii) returning the set of originals to the tray from said platen so that the set is in a reverse page sequence within the set opposite to the initial page sequence;

(b) repeating the (a)(i) resting and (a)(ii) returning steps for remaining sets of originals to change a stack sequence of the plurality of originals per the set on the tray;

(c)(i) resting the set of originals in the reverse page sequence per the set from tray onto the platen side-by-side in the feeding direction, and then (ii) discharging the originals from the platen; and (d) repeating said (c)(i) resting and (ii) discharging steps for the remaining sets of originals.

2. An original feeding method for resting a plurality of stacked originals on a platen side-by-side by using a recycle original feeding apparatus having a tray, the originals being fed from a stack of originals comprising a plurality of sets, each set including at least two originals, said method comprising the steps of:

(a) counting a number of the stacked originals on said tray by circulating the plurality of originals;

(b) replacing an initial page sequence of a set of originals by (i) resting the set of originals in the initial page sequence from said tray on said platen side-by-side in a feeding direction, and then (ii) returning the set of originals to said tray from said platen so that the set is in a reverse page sequence opposite to the initial page sequence;

(c) repeating the (b)(i) resting and (b)(ii) returning steps for each set of originals to change a stack sequence of the plurality of originals on said tray;

(d)(i) resting a set of originals in the reverse page sequence from said tray onto said platen side-by-side in the feeding direction, and then (ii) discharging them from said platen; and (e) repeating the (d)(i) resting and (d)(ii) discharging steps for each set of originals.

3. An original feeding and reading method for resting a plurality of stacked originals on a platen side-by-side by using a recycle original feeding apparatus having a tray, the originals being fed from a stack of originals comprising a plurality of sets, each set including at least two originals, said method comprising the steps of:

(a) counting a number of the stacked originals on said tray by circulating the plurality of originals;

(b) replacing an initial page sequence of a set of originals by (i) resting the set of originals in the initial page sequence from said tray on said platen side-by-side in a feeding direction, and then (ii) returning the set of originals to said tray from said platen so that the set is in a reverse page sequence opposite to the initial page sequence;

(c) repeating the (b)(i) resting and (b)(ii) returning steps for each set of originals to change a stack sequence of the plurality of originals on said tray;

(d)(i) resting a set of originals in the reverse page sequence from said tray onto said platen side-by-side in the feeding direction, and then (ii) reading an image thereon, and (iii) discharging them from said platen; and (e) repeating the (d) (i) resting, (d) (ii) image reading, and (d)(iii) discharging steps for each set of originals.

4. An original feeding and reading method for resting a plurality of stacked originals on a platen side-by-side by using a recycle original feeding apparatus having a tray, the originals being fed from a stack of originals comprising a plurality of sets, each set including at least two originals, said method comprising the steps of:

(a) replacing an initial page sequence of a set of originals by (i) resting the set of originals in the initial page sequence from the tray on said platen within the set, and then (ii) returning the set of originals to the tray from the platen so that the set is in a reverse page sequence within the set opposite to the initial page sequence;

(b) repeating said (a)(i) resting and (a)(ii) returning steps for remaining sets of originals to change a stack sequence of the plurality of originals per the set on the tray;

(c)(i) resting the set of originals in the reverse page sequence per the set from the tray onto the platen side-by-side in the feeding direction, and then (ii) reading an image thereon, and (iii) discharging the originals from the platen; and (d) repeating the (c)(i) resting, (c)(ii) image reading, and (c)(iii) discharging steps for the remaining sets of originals.

5. (Amended) An image forming method for resting and reading a plurality of stacked originals on a platen side-by-side by using a recycle original feeding apparatus having a tray, the originals being fed from a stack of originals comprising a plurality of sets, each set including at least two originals, said method comprising the steps of:

(a) replacing an initial page sequence of a set of originals by (i) resting the set of originals in the initial page sequence from said tray on said platen side-by-side in a feeding direction, and then (ii) returning them to said tray from said platen so that the set is in a reverse page sequence opposite to the initial page sequence;

(b) repeating the (a)(i) resting and (a)(ii) returning steps for each set of originals to change a stack sequence of the plurality of originals on said tray;

(c)(i) resting a set of originals in the reversed page sequence from said tray onto said platen side-by-side in the feeding direction, and then (ii) reading an image thereon;

(d) forming the image read from the set of originals on a single sheet; and (e) repeating the (c)(i) resting, (c)(ii) image reading and (d) image forming steps for each set of originals.

6. An original feeding method for resting a plurality of stacked originals on a platen side-by-side by using an original feeding apparatus having a tray, the originals being fed from a stack of originals comprising a plurality of sets, each set including at least two originals, said method comprising the steps of:

feeding a set of originals from the tray toward the platen;

replacing an initial page sequence of the set of originals within the set by causing a second-fed original to overtake a first-fed original upon feeding so that the set is in a reverse page sequence opposite to the initial page sequence within the set;

directing the set of originals in reverse page sequence to the platen for reading; and repeating said feeding and replacing steps for each set of originals.

7. An original feeding method for resting a plurality of stacked originals on a platen side-by-side by using an original feeding apparatus having a tray, the originals being fed from a stack of originals comprising a plurality of sets, each set including at least two originals, said method comprising the steps of:

counting a number of the stacked originals on said tray;

feeding a set of originals from said tray toward said platen;

replacing an initial page sequence of the set of originals by causing a second-fed original to overtake a first-fed original upon feeding so that the set is in a reverse page sequence opposite to the initial page sequence and then directing the set to said platen for reading; and repeating the feeding and replacing steps for each set of originals.

8. An original feeding and reading method for resting a plurality of stacked originals on a platen side-by-side by using an original feeding apparatus having a tray, the originals being fed from a stack of originals comprising a plurality of sets, each set including at least two originals, said method comprising the steps of:

feeding a set of originals from the tray toward the platen;

replacing an initial page sequence of the set of originals within the set by causing a second-fed original to overtake a first-fed original upon feeding so that the set is in a reverse page sequence opposite to the initial page sequence within the set;

directing the set of originals in reverse page sequence to the platen for reading; and repeating said feeding and replacing steps for each set of originals.

9. An original feeding and reading method for resting a plurality of stacked originals on a platen side-by-side by using an original feeding apparatus having a tray, the originals being fed from a stack of originals comprising a plurality of sets, each set including at least two originals, said method comprising the steps of:

counting a number of the stacked originals;

feeding a set of originals from said tray toward said platen;

replacing an initial page sequence of the set of originals by causing a second-fed original to overtake a first-fed original upon feeding so that the set is in a reverse page sequence opposite to the initial page sequence and then directing the set to said platen for reading; and repeating the feeding and replacing steps for each set of originals.

10. An image forming method for resting a plurality of stacked originals on a platen side-by-side using an original feeding apparatus having a tray, the originals being fed from a stack of originals comprising a plurality of sets, each set including at least two originals, said method comprising the steps of:

counting a number of the stacked originals on said tray;

feeding a set of originals from said tray toward said platen;

replacing an initial page sequence of the set of originals by causing a second-fed original to overtake a first-fed original upon feeding so that the set is in a reverse page sequence opposite to the initial page sequence and then directing the set to said platen for reading;

forming images read from the set of originals on a single sheet; and repeating the feeding, replacing and image forming steps for each set of originals.

11. An original feeding method for resting a plurality of originals on a platen side-by-side by using a recycle original feeding apparatus having a tray, the originals being fed from a stack of originals comprising a plurality of sets, each set including at least two originals, said method comprising the steps of:

replacing an initial page sequence of the set of originals by feeding the set of originals from the tray within the set and returning the set of originals to the tray so that the set is in a reverse page sequence within the set opposite to the initial page sequence;

repeating said replacing and returning steps for remaining sets of originals to change a stack sequence per the set of the plurality of originals on the tray;

resting a set of originals in the reverse page sequence per the set from the tray onto the platen side-by-side in the feeding direction and then discharging the set from the platen; and repeating said resting and discharging steps for the remaining sets of originals.

12. An original feeding and reading method for resting a plurality of stacked originals on a platen side-by-side by using a recycle original feeding apparatus having a tray, the originals being fed from a stack of originals comprising a plurality of sets, each set including at least two originals, said method comprising the steps of:

replacing an initial page sequence of the set of originals by feeding the set of originals from the tray within the set on the platen and returning the set of originals to the tray so that the set is in a reverse page sequence within the set opposite to the initial page sequence;

repeating said replacing and returning steps for remaining sets of originals to change a stack sequence of the plurality of originals per the set on the tray;

resting the set of originals in the reverse page sequence per the set from the tray onto the platen side-by-side in the feeding direction, reading an image thereon and then discharging the set from the platen; and repeating said resting, image reading, and discharging steps for the remaining sets of originals.

13. An image forming method for resting and reading a plurality of stacked originals on a platen side-by-side by using a recycle original feeding apparatus having a tray, the originals being fed from a stack of originals comprising a plurality of sets, each set including at least two originals, said method comprising the steps of:

replacing an initial page sequence of the set of originals by feeding the set of originals from said tray on said platen side-by-side and returning them to said tray so that the set is in a reverse page sequence opposite to the initial page sequence;

repeating the feeding and returning steps for each set of originals to change a stack sequence of the plurality of originals on said tray;

resting a set of originals in the reversed page sequence from said tray onto said platen side-by-side in the feeding direction and then reading images thereon and forming the images read from the set on a single sheet, discharging the set of originals from said platen; and repeating the resting, image reading, image forming, and discharging steps for each set of originals.

14. An original feeding and reading method for resting a plurality of stacked originals on a platen side-by-side by using an original feeding apparatus having a tray, the originals being fed from a stack of originals comprising a plurality of sets, each set including at least two originals, said method comprising the steps of:

feeding a set of originals from the tray;

replacing an initial page sequence of the set of originals within the set by causing a second-fed original to overtake a first-fed original upon feeding so that the set is in a reverse page sequence opposite to the initial page sequence within the set;

directing the set of originals in reverse page sequence to the platen for reading; and repeating said feeding and replacing steps for each set of originals.

15. (Amended) An image forming method for resting a plurality of originals on a platen side-by-side by using an original feeding apparatus having a tray, the originals being fed from a stack of originals comprising a plurality of sets, each set including at least two originals, said method comprising the steps of:

feeding a set of originals from said tray;

replacing an initial page sequence of the set of originals fed by causing a second-fed original to overtake a first-fed original upon feeding so that the set is in a reverse page sequence opposite to the initial page sequence and then directing them to said platen to read images thereon;

forming images read from the set on a single sheet; and repeating the feeding, replacing and image forming steps for each set of originals.

16. An original feeding and reading method for directing on a reading portion side-by-side by using a recycle original feeding apparatus having a tray, the originals being fed from a stack of originals comprising a plurality of sets, each set including at least two originals, said method comprising the steps of:

replacing an initial page sequence of the set of originals fed by feeding the set of originals from the tray within the set and returning the set to the tray so that the set is in a reverse page sequence within the set opposite to the initial page sequence;

repeating said replacing and returning steps for remaining sets of originals to change a stack sequence per the set in the tray;

directing the set of originals in the reverse page sequence per the set from the tray on the reading portion side-by-side in the feeding direction to read images thereon and then discharging the set from the reading portion; and repeating said directing and discharging steps for the remaining sets of originals.

17. An image forming method for directing and reading a plurality of stacked originals on a reading portion side-by-side by using a recycle original feeding apparatus having a tray, the originals being fed from a stack of originals comprising a plurality of sets, each set including at least two originals, said method comprising the steps of:

replacing an initial page sequence of the set of originals by feeding them from said tray side-by-side in a feeding direction, and returning them to said tray so that the set is in a reverse page sequence opposite to the initial page sequence;

repeating the feeding and returning steps for each set of originals to change a stack sequence of the plurality of originals on said tray;

directing a set of originals in the reverse page sequence from said tray to said reading portion side-by-side in the feeding direction to read images thereon, and then forming images read from the set of originals on a single sheet;

discharging the set of originals from said reading portion; and repeating the directing, image forming, and discharging steps for each set of originals.

18. An original feeding and reading method for directing a plurality of stacked originals on a reading portion side-by-side by using an original feeding apparatus having a tray, the originals being fed from a stack of originals comprising a plurality of sets, each set including at least two originals, said method comprising the steps of:

feeding a set of originals from the tray;

replacing an initial page sequence of the set of originals fed within the set by causing a second-fed original to overtake a first-fed original upon feeding, so that the set is in a reverse page sequence opposite to the initial page sequence within the set;

directing the set of originals in reverse page sequence to the reading portion for reading; and repeating said feeding, replacing and image reading steps for each set of originals.

19. An image forming method for directing a plurality of stacked originals on a reading portion side-by-side by using an original feeding apparatus having a tray, the originals being fed from a stack of originals comprising a plurality of sets, each set including at least two originals, said method comprising the steps of:

feeding a set of originals from the tray;

replacing an initial page sequence of the set of originals fed within the set by causing a second-fed original to overtake a first-fed original upon feeding, so that the set is in a reverse page sequence opposite to the initial page sequence within the set;

directing the set of originals in reverse page sequence to the reading portion for reading;

forming images read from the set of originals on a single sheet; and repeating said feeding, replacing and reading steps for each set of originals.

20. An original feeding and reading method for directing originals onto a reading portion side-by-side by using an original feeding apparatus having a tray, the originals being fed from a stack of originals comprising a plurality of sets, each set including at least two originals, said method comprising the steps of:

replacing an initial page sequence of the set of originals fed within the set by feeding the set of originals from the tray and returning the set to the tray so that the set is in a reverse page sequence within the set opposite to the initial page sequence;

repeating said replacing and returning steps for remaining sets of originals to change a stack sequence per the set in the tray;

directing the set of originals in the reverse page sequence per the set from the tray on the reading portion side-by-side in the feeding direction to read images thereon and then discharging the set from the reading portion; and repeating said directing and discharging steps for the remaining sets of originals.

21. A method according to any of claims 1 to 5, wherein, in said replacing step, when a number of the originals is odd, only a first original is firstly fed alone and then other originals are fed by even.

22. A method according to any of claims 6 to 10, wherein, in said replacing step, when a number of the originals is odd, only a first original is firstly fed alone and then other originals are fed by even.

23. A method according to any of claims 6 to 10, wherein the first-fed original is once fed onto said platen and then is ejected from the platen and is in a waiting condition, and thereafter, the second-fed original is fed toward said platen, meanwhile the first-fed original follows the second-fed original.

24. A method according to any of claims 6 to 10, wherein the first-fed original is once fed onto said platen and then is returned to an inversion path and is in a waiting condition, and thereafter, the second-fed original is fed toward said platen, meanwhile the first-fed original follows the second-fed original through said inversion path.

25. A method according to any of claims 6 to 10, wherein the first-fed original is once fed onto said platen and then is returned to so that a trailing end of the first-fed original is pinched by a nip between convey rollers, and is in a waiting condition; and thereafter, the second-fed original is fed toward said platen; and, when a trailing end of the second-fed original is substantially aligned with the leading end of the first-fed original, the second-fed original is fed toward said platen together with the first-fed original.

26. A method according to any of claims 6 to 10, wherein the first-fed original is once fed onto said platen and then is returned to so that a trailing end of the first-fed original is pinched by a nip between inversion and convey rollers, and is in a waiting condition; and thereafter, the second-fed original is fed toward said platen, and, at the same time, the first-fed original is fed to an inversion path by the rotation of said inversion and convey rollers; and thereafter, when the second-fed original is fed by a platen belt, said inversion and convey rollers are stopped; and thereafter, when a trailing end of the second-fed original is substantially aligned with the trailing end of the first-fed original, the second-fed original is fed toward said platen together with the first-fed original.

27. A method according to any of claims 7 and 9, wherein the first-fed original is once fed by inversion and convey rollers and is in a waiting condition; and thereafter, the second-fed original is fed toward said platen, and the first-fed original is returned by the reverse rotation of said inversion and convey rollers at the time; and thereafter, when the second-fed original is fed by a platen belt, said inversion and convey rollers are stopped; and thereafter, the second-fed original is waited on said platen, and the first-fed original is fed toward said platen by the normal rotation of said inversion and convey rollers; and thereafter, when a trailing end of the first-fed original is substantially aligned with the trailing end of the second-fed original, the second-fed original is fed toward said platen together with the first-fed original.

28. A method according to claim 27, wherein said counting step comprises an odd discriminating step.

29. A method according to claim 28, wherein the odd discrimination is effected by determining the total number of a originals.

30. A method according to claim 5, wherein the originals are fed from a lowermost one onto said platen, and further including, an odd discriminating mode for forming images of two originals on a single sheet and for discriminating whether a number of the originals is odd or even; and a mode for feed only a last page original onto said platen and for changing a stop position of the last page original from a stop position in a normal mode, when the number of the originals is odd.

31. (Amended) A method according to claim 10, wherein said original feeding apparatus comprises an original supply portion for feeding the originals on said tray, an original feeding portion for resting the originals on said platen, and an original inversion portion, wherein said original supply portion and said original inversion portion are disposed at an image reading start side, and an inversion path is used as a retarding path for the first-fed original in a side-by-side reading mode.

32. (Amended) A method according to claim 31, wherein, after the first-fed original is rested on said platen, the first-fed original is turned over twice, and, in a second turn-over, while the first-fed original is being fed in said inversion path, the second-fed original is fed to said platen, whereby the first-fed original and second-fed original are fed side by side.

33. A method according to claim 31, wherein, the first-fed original is directed to said inversion path and is temporarily waited therein, and then, the second-fed original is fed to said platen, and thereafter, the first-fed original and the second-fed original are fed side by side.

34. An original feeding method according to any of claims 6 to 10, further comprising a waiting position for replacing by said overtake at a position deviated from a path connecting said tray and said platen.

* * * * *

UNITED STATES PATENT AND TRADEMARK OFFICE

CERTIFICATE OF CORRECTION

PATENT NO. : 5,617,196 Page 1 of 5

DATED : April 1, 1997

INVENTOR(S) : NORIYOSHI UEDA, ET AL.

It is certified that error appears in the above-indentified patent and that said Letters Patent is hereby corrected as shown below:

COLUMN 1:

Line 52, "set" should read --sets--.

COLUMN 2:

Line 28, "miss-operation" should read --misoperation--.

Line 52, "miss-selection" should read --misselection--.

COLUMN 4:

Line 8, "flowing" should read --flow--.

Line 20, "obtained;" should read --obtained; and--.

COLUMN 5:

Line 56, "original" should read --originals--.

UNITED STATES PATENT AND TRADEMARK OFFICE

CERTIFICATE OF CORRECTION

PATENT NO. : 5,617,196 Page 2 of 5

DATED : April 1, 1997

INVENTOR(S) : NORIYOSHI UEDA, ET AL.

It is certified that error appears in the above-indentified patent and that said Letters Patent is hereby corrected as shown below:

COLUMN 6:

Line 29, "just reach" should read --just reached--.
Line 32, "original" should read --originals--.

COLUMN 7:

Line 53, "or should read --of--.
Line 64, "transfer-sheet" should read --transfer sheet--.

COLUMN 8:

Line 8, "be" (second occurrence) should be deleted.

COLUMN 9:

Line 26, "When" should read --¶When--.
Line 33, "surface" should red --surfaces--.

UNITED STATES PATENT AND TRADEMARK OFFICE

CERTIFICATE OF CORRECTION

PATENT NO. : 5,617,196 Page 3 of 5

DATED : April 1, 1997

INVENTOR(S) : NORIYOSHI UEDA, ET AL.

It is certified that error appears in the above-indentified patent and that said Letters Patent is hereby corrected as shown below:

COLUMN 10:

Line 9, "FIG. 21" should read --¶FIG. 21--.
Line 24, "at a" should read --all at one--.
Line 54, "resist" should read --regist--.
Line 66, "constrol" should read --control--.

COLUMN 11:

Line 22, "just pass" should read --just passed--.

COLUMN 12:

Line 26, "synchronous" should read --synchronism--.
Line 46, "synchronous" should read --synchronism--.

COLUMN 14:

Line 11, "tray" should read --the tray--.

UNITED STATES PATENT AND TRADEMARK OFFICE

CERTIFICATE OF CORRECTION

PATENT NO. : 5,617,196 Page 4 of 5

DATED : April 1, 1997

INVENTOR(S) : NORIYOSHI UEDA, ET AL.

It is certified that error appears in the above-indentified patent and that said Letters Patent is hereby corrected as shown below:

COLUMN 15:

Line 24, "(Amended)" should be deleted.
Line 46, "reading" should read --reading,--.

COLUMN 16:

Line 48, "using" should read --by using--.

COLUMN 17:

Line 57, "sheet," should read --sheet;--.

COLUMN 18:

Line 11, "(Amended)" should be deleted.
Line 27, "directing" should read --directing a plurality of stacked originals--.

UNITED STATES PATENT AND TRADEMARK OFFICE

CERTIFICATE OF CORRECTION

PATENT NO. : 5,617,196 Page 5 of 5

DATED : April 1, 1997

INVENTOR(S) : NORIYOSHI UEDA, ET AL.

It is certified that error appears in the above-indentified patent and that said Letters Patent is hereby corrected as shown below:

COLUMN 20:

Line 63, "the" should read --a--.
Line 64, "a" should read --the--.

COLUMN 21:

Line 4, "feed" should read --feeding--.
Line 8, "(Amended)" should be deleted.
Line 18, "(Amended)" should be deleted.
Line 18, "wherein," should read --wherein--.

Signed and Sealed this

Sixteenth Day of December, 1997

Bruce Lehman

*Attest:*

BRUCE LEHMAN

*Attesting Officer*

*Commissioner of Patents and Trademarks*